US012104231B2

(12) United States Patent
Kawano

(10) Patent No.: US 12,104,231 B2
(45) **Date of Patent: *Oct. 1, 2024**

(54) STEEL MATERIAL AND STEEL PRODUCT USING THE SAME

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/751,230

(22) Filed: May 23, 2022

(65) Prior Publication Data

US 2022/0380874 A1 Dec. 1, 2022

(30) Foreign Application Priority Data

May 24, 2021 (JP) ..... 2021-087176

(51) Int. Cl.
*C22C 38/24* (2006.01)
*C21D 6/00* (2006.01)
(Continued)

(52) U.S. Cl.
CPC ..... *C22C 38/24* (2013.01); *C21D 6/002* (2013.01); *C21D 7/13* (2013.01); *C22C 38/001* (2013.01);
(Continued)

(58) Field of Classification Search
CPC ..... C21D 1/26; C21D 1/32; C21D 2211/005; C21D 2211/004; C21D 6/004; C21D 6/005; C21D 6/007; C21D 6/008; C22C 38/001; C22C 38/02; C22C 38/04; C22C 38/06; C22C 38/20; C22C 38/22; C22C 38/24; C22C 38/26; C22C 38/28; C22C 38/30; C22C 38/32; C22C 38/42; C22C 38/44;
(Continued)

(56) References Cited

U.S. PATENT DOCUMENTS 6,365,096 B1 4/2002 Sandberg et al.
10,988,823 B2 * 4/2021 Kawano ..... C22C 38/22
(Continued)

FOREIGN PATENT DOCUMENTS

CN 1295624 A 5/2001
CN 108474085 A 8/2018
(Continued)

OTHER PUBLICATIONS

Extended European Search Report issued Oct. 12, 2022 for European Patent Application No. 22174990.6-1103.
(Continued)

*Primary Examiner* — Jie Yang
(74) *Attorney, Agent, or Firm* — MCGINN I.P. LAW GROUP, PLLC

(57) ABSTRACT

The present invention relates to a steel material including, in mass %: 0.310≤C≤0.410; 0.001≤Si≤0.35; 0.45≤V≤0.70; Cr≤6.00; 6.25≤Mn+Cr; Mn/Cr≤0.155; Cu+Ni≤0.84; 0.002≤P≤0.030; 0.0003≤S≤0.0060; P+5S≤0.040; 2.03<Mo<2.40; 0.001≤Al≤0.050; and 0.003≤N≤0.050, with the balance being Fe and unavoidable impurities.

10 Claims, 30 Drawing Sheets

(51) Int. Cl.

| | |
|---|---|
| ***C21D 7/13*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/20* (2013.01); *C22C 38/22* (2013.01)

(58) Field of Classification Search
CPC ..... C22C 38/46; C22C 38/60; C22C 38/40; F21S 41/25
USPC ..... 420/111
See application file for complete search history.

(56) References Cited

U.S. PATENT DOCUMENTS

| | | | | |
|---|---|---|---|---|
| 11,319,621 | B2 * | 5/2022 | Kawano | C22C 38/20 |
| 2008/0302501 | A1 | 12/2008 | Binot et al. | |
| 2017/0058385 | A1 | 3/2017 | Umemori et al. | |
| 2018/0282832 | A1 * | 10/2018 | Kawano | C21D 1/32 |
| 2019/0003021 | A1 | 1/2019 | Medvedeva et al. | |
| 2020/0232078 | A1 * | 7/2020 | Ejnermark | B33Y 70/00 |

FOREIGN PATENT DOCUMENTS

| | | | | |
|---|---|---|---|---|
| CN | 108660367 | A | 10/2018 | |
| CN | 111057934 | A | 4/2020 | |
| EP | 1 084 282 | A1 | 3/2001 | |
| EP | 1696045 | A1 * | 8/2006 | B22C 9/061 |
| EP | 2270246 | A1 * | 1/2011 | C21D 6/002 |
| EP | 3 382 053 | A1 | 10/2018 | |
| EP | 3 394 309 | A1 | 10/2018 | |
| JP | 2009-242820 | A | 10/2009 | |
| JP | 2011-001572 | A | 1/2011 | |
| KR | 20180109763 | A | 10/2018 | |
| TW | 2008-42194 | A | 11/2008 | |
| TW | 2017-13785 | A | 4/2017 | |
| WO | WO 99/050468 | A1 | 10/1999 | |
| WO | WO 2017/111680 | A1 | 6/2017 | |

OTHER PUBLICATIONS

Taiwanese Office Action, dated Feb. 7, 2023, in Taiwanese Application No. 111119224 and English Machine Translation thereof.
Chinese Office Action issued in Chinese Patent Application No. 202210576895.8 on Jul. 19, 2023 (with English translation).
Korean Office Action 10-2022-0062961 issued on Jun. 15, 2024 with English translation thereof.

* cited by examiner

Hot working and subsequent cooling step are simulated.

STEEL MATERIAL AND STEEL PRODUCT USING THE SAME

TECHNICAL FIELD

The present invention relates to a steel material and a steel product using the same. More specifically, the present invention relates to a steel material used as a material in a variety of casting such as die casting, in forging of heating and processing a material, in hot stamping (a method of heating, forming and quenching a steel sheet), in extrusion processing, in injection molding or blow molding of resins (plastics or vinyls), in molding or processing of rubbers or fiber-reinforced plastics, and so on and a steel product using the steel material.

BACKGROUND ART

The manufacturing process of a steel material used as a material of a die casting mold, etc. includes "melting-refining-casting-homogenization heat treatment-hot working-(normalizing-tempering)-spheroidizing annealing" as main steps. As for normalizing and tempering, both or either one is sometimes omitted.

The examples of the manufacturing process of a mold from the steel material include an HT process that is performed in order of "rough working (machining into a rough mold shape)-quenching-tempering-finish machining-surface modification".

Five important properties required for the steel material and mold in the process above are (1) spheroidizing annealing property (SA property), (2) machinability, (3) quenchability (impact value when the quenching rate is small), (4) heat checking resistance, and (5) softening resistance. The (1) SA property becomes a problem in the manufacture of a steel material. Each of (2) machinability and (3) quenchability becomes a problem at the time of manufacturing a mold from the steel material. Also, each of (3) quenchability, (4) heat checking resistance and (5) softening resistance becomes a problem in the use of a mold. In the following, the reasons why these 5 properties are necessary are described.

<(1) SA Property>

SA (spheroidizing annealing) indicates to apply, for example, a slow cooling method to a "microstructure where carbides are dispersed in austenite phase and the ferrite phase is very small or nil", which is obtained by heating a steel material in a furnace in a temperature range of Ac3 temperature minus 10° C. to Ac3 temperature plus 50° C. Ac3 temperature is a temperature at a transformation from ferrite phase to austenite phase is completed on heating process of a steel.

In the slow cooling method, controlled cooling is performed at 5° C./H to 60° C./H (the cooling rate depends on the components or particle diameter) to transform the matrix phase to ferrite and simultaneously allow for growing of carbides and when no austenite is retained (when cooled to 550° C. to 800° C., though it depends on the components or cooling rate), the controlled cooling is stopped. Then, the steel material is taken out of the furnace.

The heating temperature is often from 830° C. to 950° C., though it depends on the components of the steel material, and the steel material after SA has a hardness of 260 Hv or less in terms of Vickers hardness.

In the case where untransformed austenite is retained in the steel material at the time of taking out from the furnace, the austenite is transformed to bainite or martensite due to cooling after taking out from the furnace. Such a steel material includes a mix of "a hard (300 Hv or more) portion of bainite or martensite" and "a site where carbides are dispersed in the ferrite matrix phase, i.e., a soft (approximately 260 Hv or less) portion, which is an SA microstructure". FIG. 1 shows an image of such an SA defect.

FIG. 1 shows a state where a steel material with an SA defect is subjected to mirror polishing and chemical corrosion, and it is seen that a gray region and a white region are mixed (the color tone or contrast differs depending on the chemical solution, corrosion time, whether the image is color or monochrome, etc.) The hardness was measured by indenting a Vickers indenter into each region. In FIG. 1, each of the marks "□" indicated by an arrow is a dent. In the gray region, the dent was large, and the hardness was 198 Hv. This is a hardness of normal SA microstructure, and it is understood that the gray region is "a site where carbides are dispersed in ferrite matrix phase", which was softened surely by SA. On the other hand, in the white region, the dent was small, and the hardness was very high as 462 Hv. This is a region where untransformed austenite, which is retained at the time of taking out the steel material from the furnace after the completion of controlled cooling of the slow cooling method, is transformed to bainite or martensite during subsequent cooling.

When a steel material having an SA defect portion is cut by a saw, as pointed by an arrow in FIG. 2, a site where the surface roughness or luster differs from the surroundings (the hard portion of FIG. 1) appears in the cut surface. This "grain"-looking site is a hard (martensite or bainite) region of 300 Hv or more.

In the case where a mold is manufactured by the above-described HT process from a steel material with an SA defect as shown in FIG. 2, for example, the hard portion disadvantageously causes significant wear to a machining (cutting) tool and shortens the tool life.

Therefore, the steel material is required to have "good SA property". However, a steel material having good SA property generally has poor quenchability. In general, a steel material having good SA property is often a high C-low Mn steel. In such a steel material, carbides readily precipitate during cooling for quenching, and ferrite transformation is likely to proceed as well, making it difficult to obtain a bainite or martensite microstructure.

<(2) Machinability>

The manufacturing process of a mold necessarily includes machining. The steel material cut in the machining is required to cause less wear of the working tool even when worked at high speed. In the case where the tool wears significantly, the tool replacement frequency increases, leading to a rise in the cost, and moreover, since the working speed must be reduced, the working efficiency decreases. Machining is desired to be accomplished inexpensively and quickly. Accordingly, the steel material is required to be efficiently worked at low cost, i.e., to have "good machinability". However, a steel material having good machinability is generally poor in the heat checking resistance. This is because, in general, a steel material having good machinability is a high Si-high P-high S steel, and such a steel has a low thermal conductivity, is brittle and contains a large amount of S compound, which may cause an abnormal substance, resulting in allowing a high thermal stress to act on a material susceptible to rapid formation or development of cracks.

<(3) Quenchability (Impact Value when the Quenching Rate is Small)>

The mold is thermally refined to a predetermined hardness by quenching and tempering, and used for die casting. The mold requires not only hardness but also high impact value. The reason therefor is because a mold having a high impact value is less likely to cause gross cracking. The impact value increases as the quenching rate is higher, and therefore, in the quenching, rapid cooling is usually desired. The reason why the impact value increases as the quenching rate is higher is because a martensite microstructure is created. In the case where the quenching rate is low, a bainite microstructure is created and therefore, the impact value is low.

In recent years, the die casting mold tends to increase in size. Behind this tendency, there is a fact that a die-casting cast product in itself is getting larger as a result of an increase in size of automobiles. In the case where the mold is enlarged, the cooling rate during quenching lowers (making cooling difficult). This tendency is pronounced particularly inside the mold. Consequently, with the recent increase in the mold size, reduction in the impact value inside of the mold is becoming a big problem. In the case where the cooling for quenching is intensified so as to obtain a high impact value even in a large mold, quenching cracks are readily generated during cooling and even if not cracked, excessively large thermal deformation is likely to occur.

Under these circumstances, a steel material capable of obtaining a high impact value even in the case where the quenching rate is low, i.e., a steel material with "good quenchability" (coarse bainite is not formed even in the case where the quenching rate is low), is strongly demanded. However, a steel material having good quenchability generally has poor SA property. In general, a steel material having good quenchability is a low C-high Mn steel. In such a steel material, carbides are hard to grow during cooling of SA, and ferrite transformation also hardly proceeds, making it difficult to obtain a SA microstructure where carbides are dispersed in the ferrite matrix phase.

<(4) Heat Checking Resistance>

The surface of a die casting mold is exposed to a cycle consisting of temperature rise by contacting with a molten metal and cooling by applying a mold release agent. Such temperature amplitude leads to generation of thermal stress, and combined with mechanical stress caused by mold clamping or injection, fatigue microcracks (heat checks) occur on the mold surface. Heat checks which looks like crack are often distributed in a mesh or grid pattern at a flat surface or a curved surface. When heat checks are observed by cutting the mold, the heat check opening is present on the mold surface. In the case where a molten metal enters the opening and solidifies, a convex is formed there and transferred to the cast product surface. In the case where heat checks are thus transferred to a cast product, the surface quality of the cast product deteriorates.

For these reasons, the mold is required to hardly allow occurrence of heat checking, i.e., have "good heat checking resistance". However, a steel material having good heat checking resistance generally has poor machinability. In general, a steel material having good heat checking resistance is a low Si-low P-low S steel. Such a steel material readily adheres to a cutting tool, contains a small amount of S compound producing a lubricating action on the cutting surface, has high toughness and high stickiness and, therefore, is difficult to grind.

<(5) Softening Resistance >

The temperature of the die casting mold surface rises due to contact with a molten metal. In the case where the number of casting shots is increased, the cumulative time of exposure to a high temperature increases, and the hardness of the mold surface may be reduced. Such softening involves a reduction in the high-temperature strength and in turn, the heat checking resistance deteriorates.

For these reasons, the die casting mold is required to be less likely to cause softening, i.e., have "high softening resistance". However, a steel material having high softening resistance generally has low high-temperature strength. Because, in general, a steel material having high softening resistance is a low Cr steel, and such a steel material causes poor solid-solution strengthening at high temperature.

A steel material satisfying all of the above-described 5 properties (1) to (5) is not known so far. The properties that SKD61 as general-purpose steel for die casting mold lacks are (3) quenchability, (4) heat checking resistance, and (5) softening resistance. The properties that a steel obtained by improving the properties (3), (4) and (5) of SKD61 lacks are (1) SA property and (2) machinability. In other words, it is very difficult to enhance at the same time properties on which elements produce conflicting effects.

Incidentally, as for the related technology of the present invention, Patent Literature 1 discloses a hot work tool steel having cuttability enough to enable industrial machining into a mold shape and having high thermal conductivity and high impact value, compared with general-purpose mold steel. However, this patent literature lacks idea of increasing all of the above-described 5 properties in good balance, which the present invention intends to achieve, and also lacks disclosure of Examples specifically satisfying the chemical composition of the present invention.

Patent Literature 1: JP-A-2011-1572

SUMMARY OF INVENTION

Under these circumstances, an object of the present invention is to provide a steel material excellent in spheroidizing annealing property, machinability, quenchability, heat checking resistance and softening resistance, and a steel product using the steel material.

The present inventors have conducted many studies so as to attain the object above and, as a result, found the following points.

(i) In the case where carbides distributed in a coarse network manner are produced during cooling after hot working, the carbides cannot be eliminated by the subsequent heat treatment and becomes a factor reducing the impact value of the mold. Precipitation of such carbides can be suppressed by optimizing the Si amount and V amount, and the impact value can thereby be highly stabilized.

(ii) In the case where the Mn amount and C amount are specified in narrow ranges by the parameters "Cr", "Mn+Cr", "Mn/Cr", both (1) SA property and (3) quenchability, on which elements produce conflicting effects, can be satisfied, and both (3) quenchability and (5) softening resistance, on which elements produce conflicting effects, can also be satisfied, so that these (1) SA property, (3) quenchability and (5) softening resistance can be kept high.

(iii) In a low Si steel material, it is difficult to ensure (2) machinability, but in the case where the P amount and S amount are specified in narrow ranges by the parameter "P+5S", despite low Si, it becomes possible to have machinability capable of withstanding practical use, be less likely to cause heat checking, and minimize the reduction in impact value.

The present invention is based on the above knowledge and relates to the following configurations (1) to (9):

(1) A steel material including, in mass %:

$0.310 \leq C \leq 0.410$;

$0.001 \leq Si \leq 0.35$;

$0.45 \leq V \leq 0.70$;

$Cr \leq 6.00$;

$6.25 \leq Mn+Cr$;

$Mn/Cr \leq 0.155$;

$Cu+Ni \leq 0.84$;

$0.002 \leq P \leq 0.030$;

$0.0003 \leq S \leq 0.0060$;

$P+5S \leq 0.040$;

$2.03 < Mo < 2.40$;

$0.001 \leq Al \leq 0.050$; and $0.003 \leq N \leq 0.050$, with the balance being Fe and unavoidable impurities.

(2) The steel material according to (1), including the Cr and Mn in ranges of, in mass %, $5.58 \leq Cr \leq 6.00$ and $0.60 \leq Mn \leq 0.86$.

(3) The steel material according to (1) or (2), further including, in mass %, at least one element selected from the group consisting of $0.30 < W \leq 2.00$ and $0.30 < Co \leq 1.00$.

(4) The steel material according to any one of (1) to (3), further including, in mass %, $0.0002 < B \leq 0.0080$.

(5) The steel material according to any one of (1) to (4), further including, in mass %, at least one element selected form the group consisting of $0.004 < Nb \leq 0.100$, $0.004 < Ta \leq 0.100$, $0.004 < Ti \leq 0.100$, and $0.004 < Zr \leq 0.100$.

(6) The steel material according to any one of (1) to (5), further including, in mass %, at least one element selected from the group consisting of $0.0005 < Ca \leq 0.0500$, $0.03 < Se \leq 0.50$, $0.005 < Te \leq 0.100$, $0.01 < Bi \leq 0.50$, and $0.03 < Pb \leq 0.50$.

(7) The steel material according to any one of (1) to (6), in which the steel material has an impact value of 20 [J/cm$^2$] or more when a square bar of 12 mm×12 mm×55 mm prepared from the steel material is thermally refined to a hardness of 45.5 HRC to 46.5 HRC by the following heat treatment in a vacuum furnace, an impact test specimen is prepared from the square bar, and an impact test is conducted at 15° C. to 35° C., in the heat treatment, the square bar is held at 1,250° C. for 0.5 H; then cooled from 1,250° C. to 1,000° C. at 2° C./min to 10° C./min, cooled from 1,000° C. to 600° C. at 2° C./min, and cooled from 600° C. to 150° C. at 2° C./min to 10° C./min; then heated to Ac3 temperature+25° C.; held at Ac3 temperature+25° C. for 1 H; then cooled from Ac3 temperature+25° C. to 620° C. at 15° C./H, and cooled from 620° C. to 150° C. at 30° C./H to 60° C./H; subsequently held at 1,030° C. for 1 H; then cooled from 1,030° C. to 600° C. at 60° C./min to 100° C./min, cooled from 600° C. to 450° C. at 45° C./min to 100° C./min, cooled from 450° C. to 250° C. at 30° C./min to 100° C./min, and cooled from 250° C. to 150° C. at 5° C./min to 30° C./min; and subsequently, a cycle consisting of heating to a temperature range of 580° C. to 630° C. and cooling to 100° C. or less is applied one or more times.

The shape of the impact test specimen is in accordance with JIS Z2242:2018 (10 mm×10 mm×55 mm, the radius of arc at the notch tip is 1 mm, the depth of the notch is 2 mm, and the specimen cross-sectional area in the notch bottom-below part is 0.8 cm$^2$). The impact value [J/cm$^2$] is a value obtained by dividing an absorption energy [J] by the specimen cross-sectional area (0.8 [cm$^2$]) in the notch bottom-below part and the impact value as used herein indicates an average value of impact values of 10 specimens.

Also, the Ac3 temperature is a value measured as a temperature where the ratio of ferrite phase becomes almost 0% when a specimen is heated at a rate of 200° C./H, and the Ac3 temperature as used herein indicates an average value of 10 specimens. "H" and "min" in units regarding time period and/or rate means hour(s) and minute(s), respectively.

(8) The steel material according to any one of (1) to (6), in which the steel material includes no carbides having a maximum length of more than 0.3 μm, or if the steel material includes carbides having a maximum length of more than 0.3 μm, carbides forming a dashed-line-form discontinuous string at intervals of 50 μm or less has the maximum length of more than 0.3 μm and less than 0.6 μm, or a length of a dashed-line-form discontinuous string at intervals of 50 μm or less is less than 300 μm when the dashed-line form discontinuous string is formed of carbides having a maximum length of 0.6 μm or more.

(9) A steel product formed of the steel material according to (7) or (8).

Here, the "steel product" encompasses molds or parts used in a variety of casting such as die casting, in forging of heating and processing a material, in hot stamping, extrusion processing, in injection molding or blow molding of resins, and in molding or processing of rubbers or fiber-reinforced plastics. Furthermore, the "steel product" also encompasses molds or parts including the steel material of the present invention, which have been subjected to a surface treatment or emboss processing.

According to the present invention, a steel material excellent in spheroidizing annealing property, machinability, quenchability, heat checking resistance and softening resistance and a steel product using the steel material can be provided.

DESCRIPTION OF EMBODIMENTS

Figure 1:
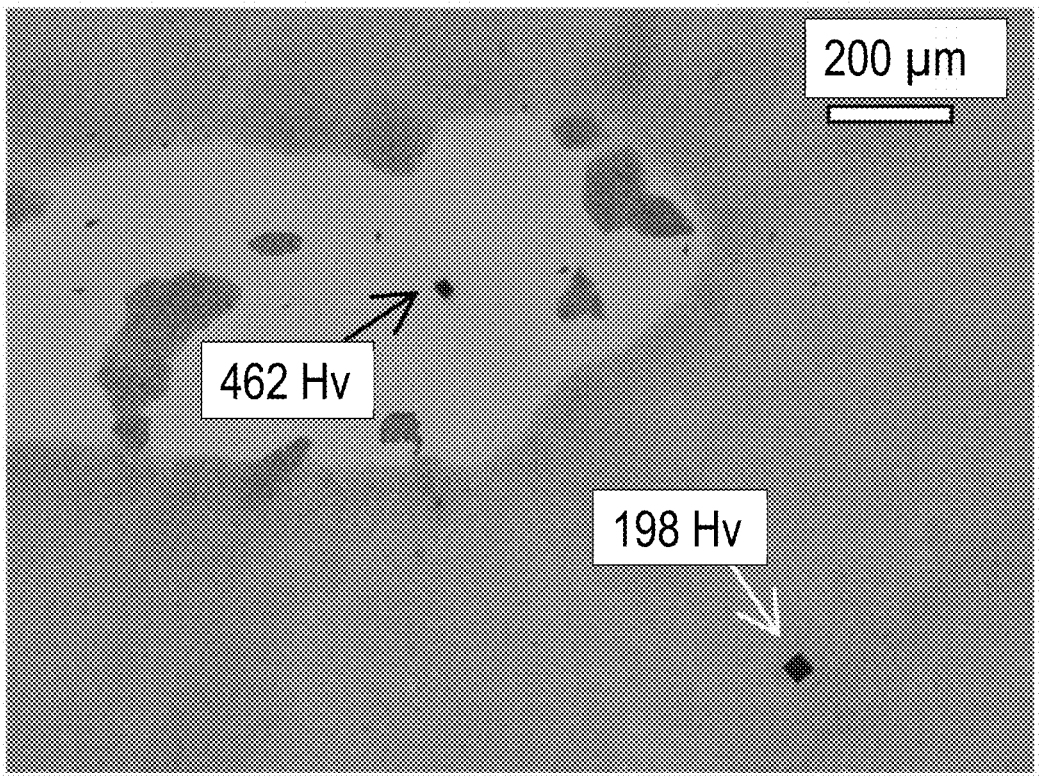
FIG. 1 is a micrograph showing a microstructure of an SA defect portion.

The steel material of the present invention is described in detail below.

(Findings Leading to the Present Invention)

A representative example of die casting mold steel is SKD61 (0.40C-1.03Si-0.40Mn-5.00Cr-1.21Mo-0.86V) that is JIS standard steel (JIS G 4404: 2015). As for SKD61, the machinability is good, but, on the other hand, the quenchability is low, because Mn+Cr is only 5.4%. Then, in order to enhance the quenchability, basic studies were conducted using steel where Mn and Cr of SKD61 were increased to 0.8% and 5.9%, respectively (hereinafter, referred to as SKD61H).

A SKD61H steel material having a width of 800 mm, a thickness of 350 mm and a length of 2,300 mm (hereinafter, such a material is referred to as a block material) was produced using an industrial facility and manufacturing method. Furthermore, the steel material was softened to a hardness of 100 HRB or less facilitating machining, by SA of heating at 920° C. that is higher than Ac3 temperature. A 493 kg-mold was manufactured from the block material, and quenched at 1,030° C. and thermally refined to a hardness of 45.5 HRC to 46.5 HRC by multiple times of tempering at 580° C. to 630° C. An impact test was conducted with a material cut out from the vicinity of the mold central part, as a result, the value was a very low value of 11 J/cm$^2$. An impact value of 20 J/cm$^2$ or more is necessary for the die casting mold so as to avoid gross cracking. Accordingly, the low impact value of SKD61H having high quenchability was considered to be attributed to "a factor other than quenchability".

Then, studies have been attempted to investigate the cause of the low impact value of SKD61H despite high quenchability by evaluating the impact value, using a material cut out from the vicinity of the center of the block material, with a sufficiently large quenching rate i.e., under the conditions where the quenchability does not become a problem.

Ten impact test specimens were produced, and the shape thereof was in accordance with JIS Z2242:2018 (10 mm×10 mm×55 mm, the radius of arc at the notch tip was 1 mm, the depth of the notch was 2 mm, and the specimen cross-sectional area in the notch bottom-below part was 0.8 cm$^2$). The impact value [J/cm$^2$] is a value obtained by dividing an absorption energy [J] determined at room temperature by the specimen cross-sectional area of 0.8 [cm$^2$] in the notch bottom-below part and indicates an average value of 10 specimens. The specimen shape and evaluation method (room temperature, dividing the absorption energy by cross-sectional area, average of 10 specimens) described here are also applied to the impact values referred to hereinafter.

A material (bar material) of 12 mm×12 mm×55 mm produced from the vicinity of the center of the block material was heated in vacuum at 1,030° C., held for 1 H and then quenched by rapid cooling to yield a martensite microstructure. The cooling rate to 250° C. from 450° C., which greatly affects the impact value, was as large as 30° C./min (in the case of a large die casting mold, the cooling rate to 250° C. from 450° C. is generally from 1.2° C./min to 10° C./min). Subsequently, the material was thermally refined to a hardness of 45.5 HRC to 46.5 HRC by multiple times of tempering at 580° C. to 630° C., and a specimen was produced from the bar material and evaluated for the impact value. As a result, the impact value was as low as 14 J/cm$^2$ that is at a level slightly higher than in the central part of the above-described 493 kg-mold. The fracture surface of this specimen exhibited a very rough state looking as if coarse crystal grains had dropped off. A specimen cut out from the central part of the 493 kg-mold also showed such a rough fracture surface.

Figure 3A:
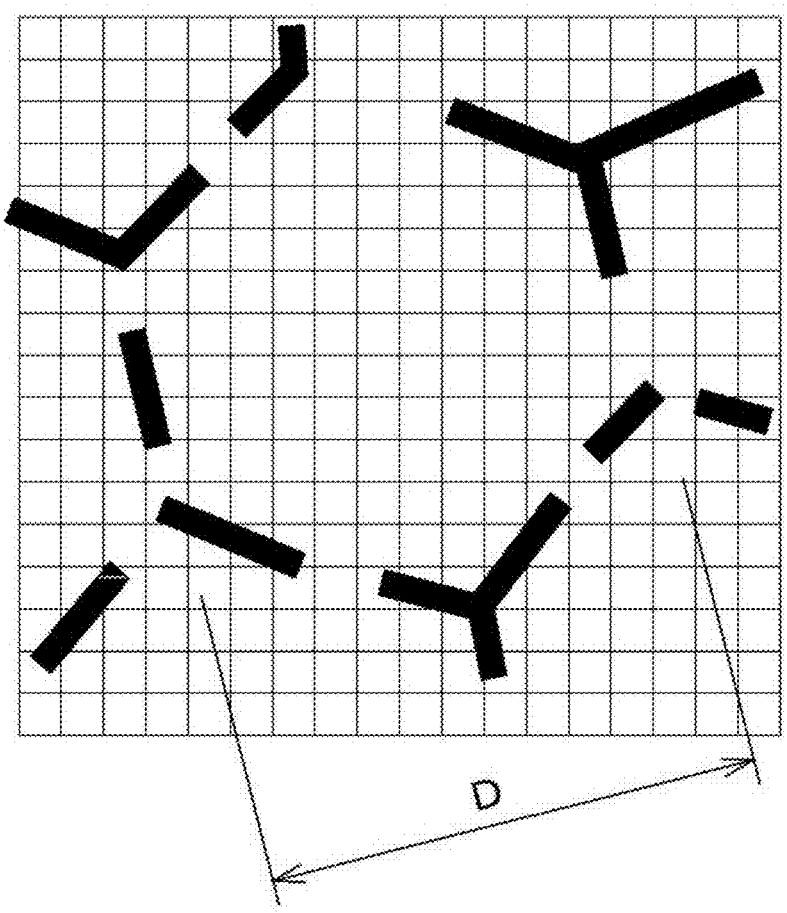
FIG. 3A is a schematic diagram of a martensite microstructure of a steel material having a low impact value.

The reason why the impact value was low and the fracture surface was rough although the quenching was rapid cooling and the microstructure was a martensite microstructure was because of the presence of carbides or carbonitrides (hereinafter, simply referred to as "carbides") distributed in a coarse network manner. This state is schematically depicted in FIG. 3A. Austenite crystal grains at the time of quenching are fine as an average grain size of 100 μm or less (in FIG. 3A, represented by small squares in a grid). On the other hand, the carbide network (in FIG. 3A, the hexagon-looking region defined by the distribution state of thick lines) looking like a polygon at low magnification is very coarse. The length of a site corresponding to one side of the polygon sometimes exceeds 200 μm and in such a case, the diameter D as a polygon exceeds 300 μm. This coarse carbide network serves as a fracture surface unit and despite martensite transformed from fine austenite crystal grains, the impact value is very low, yielding a coarse fracture surface looking as if coarse crystal grains have dropped off.

Figure 3B:
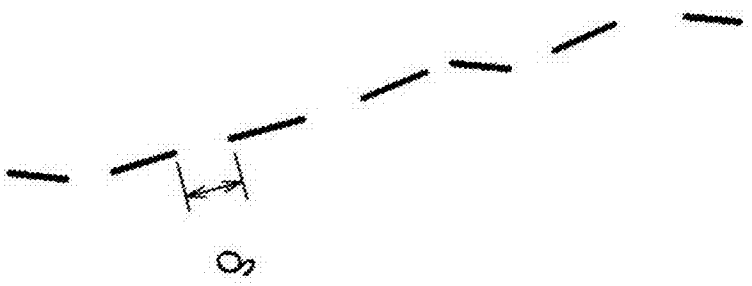
FIG. 3B is a schematic diagram illustrating an exemplary mode of carbides of FIG. 3A.
Figure 3C:
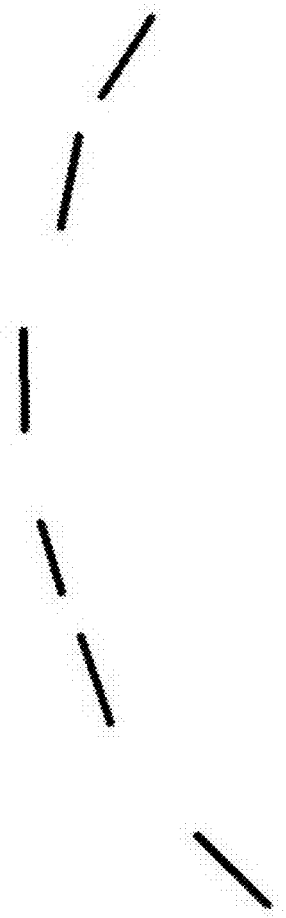
FIG. 3C is a schematic diagram illustrating another exemplary mode of carbides of FIG. 3A.

The carbide network does not always form a side-closed polygon but often forms a polygon missing sides, an irregular shape, a U shape, or simply a linear shape as illustrated in FIG. 3B or an arc shape as illustrated in FIG. 3C. Incidentally, in FIG. 3A, the carbide distribution or network is depicted as exaggerated to aid in understanding.

In order to elucidate the historical trail of "carbides distributed in a coarse network manner", the production process of a block material was confirmed, and the temperature transition was estimated by numerical analysis. The production process was "melting-refining-casting-homogenization heat treatment-hot working-normalizing-tempering-SA". Hot working is a step of forming an ingot having been subjected to homogenization treatment into a block shape. Specifically, an ingot having been subjected to homogenization heat treatment at 1,150° C. to 1,350° C. is subjected to forming by plastic working such as forging. After the completion of hot working into a predetermined shape, the block material is slowly cooled while avoiding rapid cooling so as to prevent it from cracking.

The "carbides distributed in a coarse network manner" illustrated in FIG. 3A are highly likely to "be precipitated during cooling to 600° C. after the completion of hot working". There are two grounds. The first ground is that the size and shape of the network have a close resemblance to those of austenite crystal grains at the time of hot working. The second ground is that carbon diffusion essential to precipitate carbides occurs actively in the temperature range of 600° C. or more. The range of less than 600° C. is a temperature range where non-diffusion transformation such as bainitic transformation or martensitic transformation occurs, and it is difficult for carbon to diffuse into the grain boundary and form carbide.

Based on the presumptions above, the cooling rate to 600° C. after the completion of hot working was estimated by numerical analysis and found to be about 1° C./min in the central part of a block material of 800 mm in width and 350 mm in thickness. The size of the block material varies from 200 mm to 1,500 mm in width and from 80 mm to 600 mm in thickness, but those commonly termed the "large" block material have a width of 300 mm or more and a thickness of 200 mm or more (conventionally, the smaller dimension is treated as the thickness). In the case where such a large block material was slowly cooled while avoiding rapid cooling so as to prevent it from cracking after hot working, the cooling rate to 600° C. in the central part was about 1.5° C./min or less.

Figure 4:
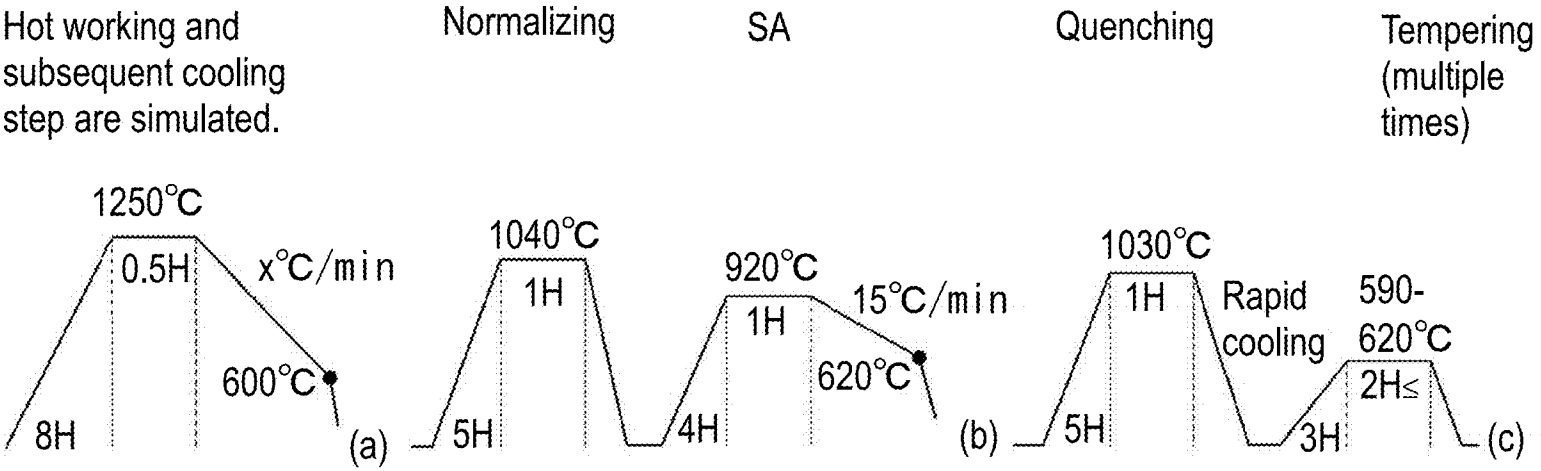
FIG. 4 is a diagram illustrating a heat treatment process at the time of examining the effect of a cooling rate after hot working on the impact value.

Then, the effect of the cooling rate to 600° C. after the completion of hot working on the impact value of SKD61H was examined A heat treatment process assuming an industrial production method is illustrated in FIG. 4. Out of the production process "melting-refining-casting-homogenization heat treatment-hot working-(normalizing-tempering)-SA" of a steel material, hot working and subsequent steps were simulated, and tempering after normalizing was omitted. Quenching and tempering after SA correspond to thermal refining of mold. Ten bar materials of 12 mm×12 mm×55 mm were thermally refined to a hardness of 45.5 HRC to 46.5 HRC by the process of FIG. 4, and specimens were produced from the resulting bar materials and evaluated for the impact value.

Incidentally, a vacuum furnace was used here for a series of heat treatments. Also, the "rapid cooling" of 1,030° C. quenching in FIG. 4 means that the cooling rate to 250° C. from 450° C., which greatly affects the impact value, was as large as 30° C./min.

Figure 5:
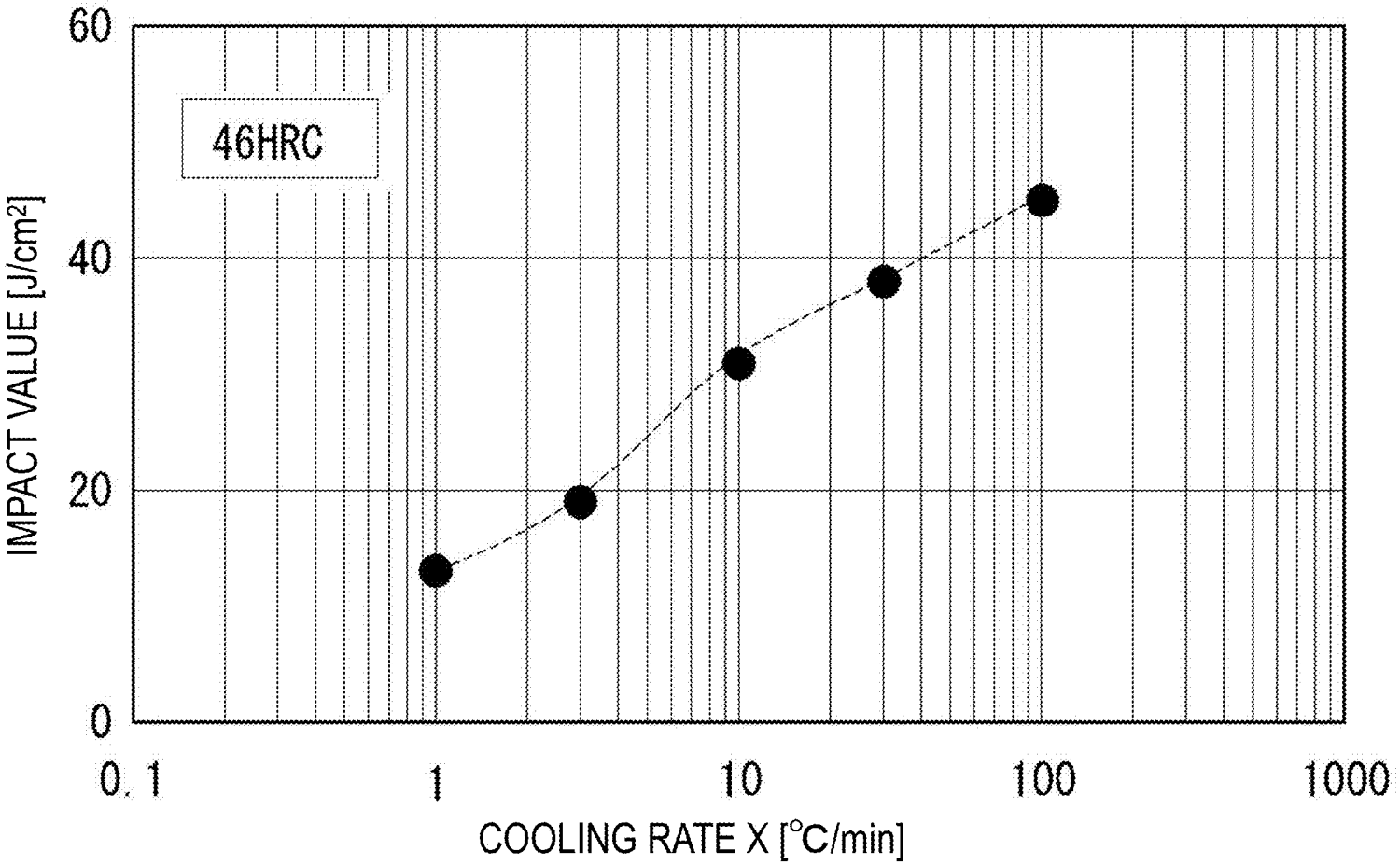
FIG. 5 is a graph showing the relationship between the cooling rate after hot working and the impact value.

Impact values obtained are shown in FIG. 5. The cooling rate X on the abscissa axis is a cooling rate to 600° C. from the completion of 1,250° C. heating simulating hot working (see, FIG. 4). As shown in FIG. 5, as X decreases, i.e., when the cooling after heating simulating hot working is slow, the impact value decreases. Correspondingly, the "carbides distributed in a coarse network manner" in the state (a) of FIG. 4, i.e., in the state where cooling after hot working is completed, are more prominent as X is smaller.

According to the above-described series of verifications, there is a steel material with a component in which even when the cooling rate of 1,030° C. quenching is large and martensite is formed, if the cooling rate X to 600° C. after hot working is small, a high impact value is not obtained. This phenomenon is a finding that has not been conventionally known.

The discovered phenomenon above is a trigger for developing the steel material of the present invention, and the contents of various alloy elements are specified so that precipitation of carbides distributed in a coarse network manner can be suppressed even when cooling rate after hot working is small.

(Reasons for Limiting Chemical Components, etc.)

The reasons for limiting chemical components, etc. in the steel material of the present invention are described in detail below. Incidentally, in the following description, the amounts of respective elements are indicated in terms of "mass %" and "%" means "mass %", unless otherwise specified.

$0.310 \leq C \leq 0.410$:

The problems of $C<0.310$ are as follows. The amount of fine particles (carbides or carbonitrides), so-called "pinning particles", having a diameter of less than 0.6 μm, which suppress the growth of austenite crystal grains, runs short at the time of quenching heating at 1,000° C. to 1,050° C., as a result, the crystal grains are coarsened, and the steel material properties such as impact value, fracture toughness value and ductility are deteriorated. The tendency for the amount of pinning particles to run short is pronounced in the case where the Si amount, V amount and N amount are small.

Additionally, in the case of $C<0.310$, it is difficult to obtain a hardness of 52 HRC or more in the case where tempering for 2 H or more is performed in a temperature range of 555° C. or more. A high hardness of 52 HRC or more is necessary in the case of intending to ensure very high heat checking resistance. In addition, there are two reasons for the tempering at 555° C. or more. The first reason is suppression of softening. The surface of a die casting mold sometimes reaches about 555° C. due to contact with a molten metal. In order to suppress softening when exposed to such a high temperature, the quenched mold is in advance tempered at 555° C. or more. The second reason for tempering at 555° C. or more is decomposition of retained austenite. If the retained austenite decomposes during use as a die casting mold, a stress may be generated to shorten the mold life. In order to avoid such a problem, the quenched mold is in advance tempered at 555° C. or more to decompose retained austenite.

The problems of 0.410<C are as follows. In the production process "melting-refining-casting-homogenization heat treatment-hot working-(normalizing-tempering)-SA" of a steel material, the proportion of carbides or carbonitrides crystallizing in a coarse state during solidification in casting increases. It is difficult to eliminate such a coarse crystallized product by solid-dissolving through subsequent heat treatments (homogenization heat treatment, tempering, SA). Eventually, the crystallized product remains without completely solid-dissolving even after quenching-tempering (the crystallized product partially solid-dissolves and becomes small in the homogenization heat treatment but is yet observed in a state where the diameter exceeds 1 μm). Then, the crystallized product remaining without completely dissolving serves as a starting point of fracture, leading to a reduction in the impact value or fatigue strength. The problem caused by the coarse crystallized product is likely to be pronounced in the case where the Si amount, V amount and N amount are large.

Furthermore, in the case of 0.410<C, a phenomenon where the impact value is reduced in the case where the cooling rate after hot working is small (see, FIG. 5) becomes apparent. This tendency is likely to be pronounced in the case where the Si amount, V amount and N amount are large.

The range is preferably 0.315≤C≤0.405 and more preferably 0.325≤C≤0.400.

0.001≤Si≤0.35:

The problems of Si<0.001 are as follows. An expensive raw material having a low Si content must be used, and the steel material cost rises. Also, it becomes difficult to reduce the oxygen content during refining, as a result, coarse alumina or a cluster thereof increases. Such alumina serves as a starting point of fracture, leading to a reduction in the impact value or fatigue strength. Furthermore, with an ultralow Si content, machinability is significantly reduced, making it difficult to stably perform machining in industry.

The problems of 0.35<Si are as follows. In the case where the C amount, V amount and N amount are large, a coarse crystallized product increasingly forms. In addition, a phenomenon where the impact value is reduced in the case where the cooling rate after hot working is small (see, FIG. 5) becomes apparent. Furthermore, with a high Si content, a thermal stress during casting increases due to reduction in the thermal conductivity, resulting in deterioration of the heat checking resistance. The fracture toughness value decreases and in turn, the risk of gross cracking increases.

The range is preferably 0.005≤Si≤0.33 and more preferably 0.010≤Si≤0.31. In the case of placing emphasis on good heat checking resistance, the range is suitably Si≤0.15 at which machinability is slightly sacrificed.

Figure 6:
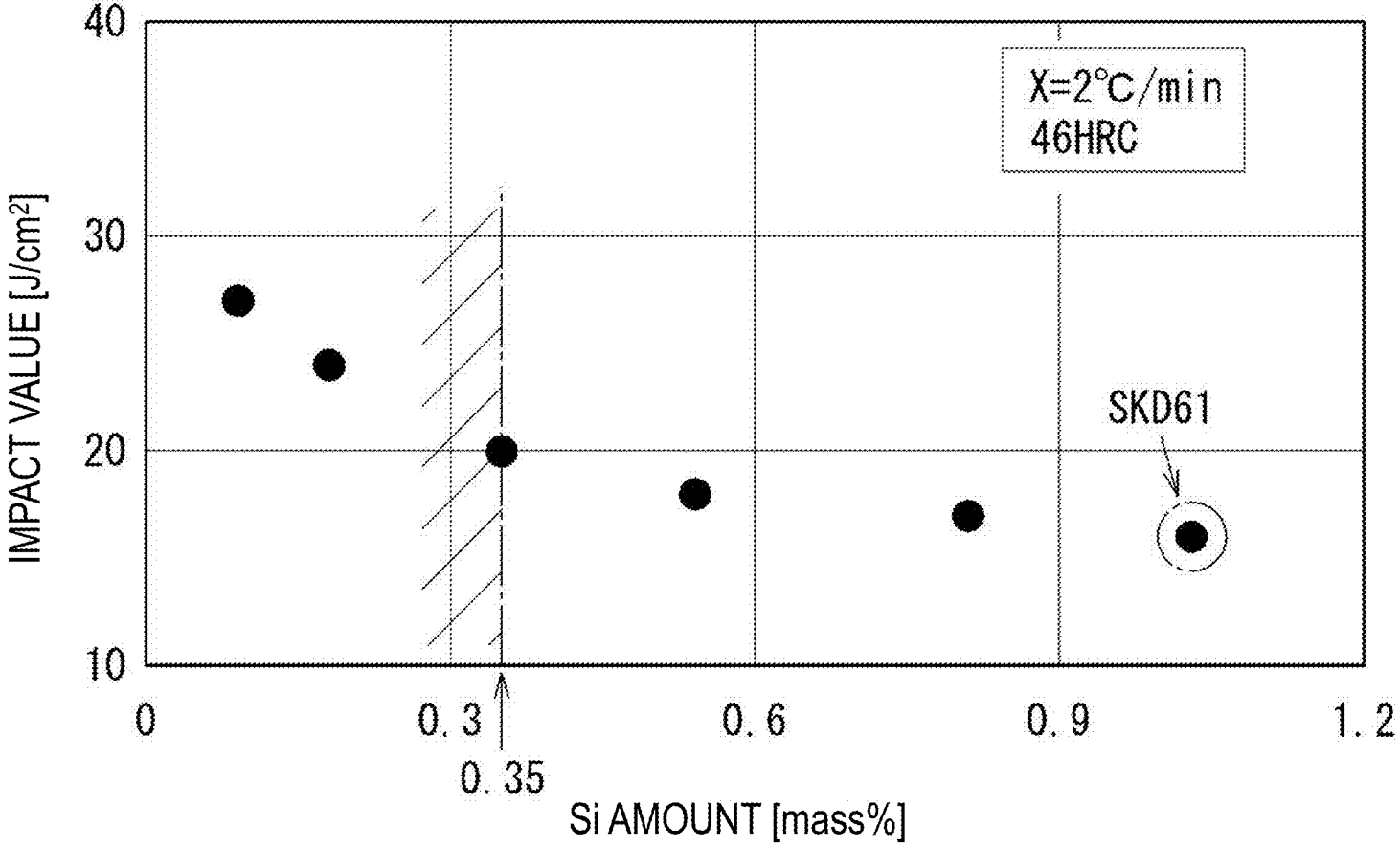
FIG. 6 is a graph showing the relationship between the Si amount and the impact value.

In the following, from the viewpoint of impact value in the case where the cooling rate after hot working is small, the reason for specifying the Si amount is described. FIG. 6 shows impact values of total 6 types of steel materials prepared by changing the Si amount of SKD61. Since this is a verification under the conditions where the quenchability does not become a problem (a small specimen is quenched at a large cooling rate), SKD61 was used as a standard steel. The heat treatment process and conditions of the bar material as specimen of 12 mm×12 mm×55 mm were in accordance with FIG. 4, and the cooling rate after 1,250° C. heating was X=2° C./min. In the case where the amount of Si was decreased from SKD61, the impact value rose. The condition for achieving the impact value of 20 J/cm$^2$ or more required for a die casting mold is Si≤0.35. For this reason, the upper limit is specified to be Si≤0.35. Incidentally, the condition for satisfying the impact value of 25 J/cm$^2$ or more that is ideally required for a die casting mold, is Si≤0.15.

0.45≤V≤0.70:

The problems of V<0.45 are as follows. The amount of pinning particles at the time of quenching heating decreases. The amount of V nitrides acting as pinning particles as with carbides or carbonitrides also decreases. The tendency for the amount of pinning particles to decrease is pronounced in the case where the C amount, Si amount and N amount are small. Also, in the case of V<0.45, the secondary hardening performance of tempering is low and therefore, in the case where tempering for 2 H or more is performed at 555° C. or more, it is difficult to obtain a hardness of 52 HRC or more.

The problems of 0.70<V are as follows. A coarse crystallized product increasingly forms. This tendency is pronounced in the case where the C amount, Si amount and N amount are large. Also, a phenomenon where the impact value is reduced in the case where the cooling rate after hot working is small becomes apparent. Furthermore, the V compound as raw material is expensive and therefore, in the case of 0.70<V, the steel material cost rises. The range is preferably 0.46≤V≤0.69 and more preferably 0.47≤V≤0.68.

Figure 7:
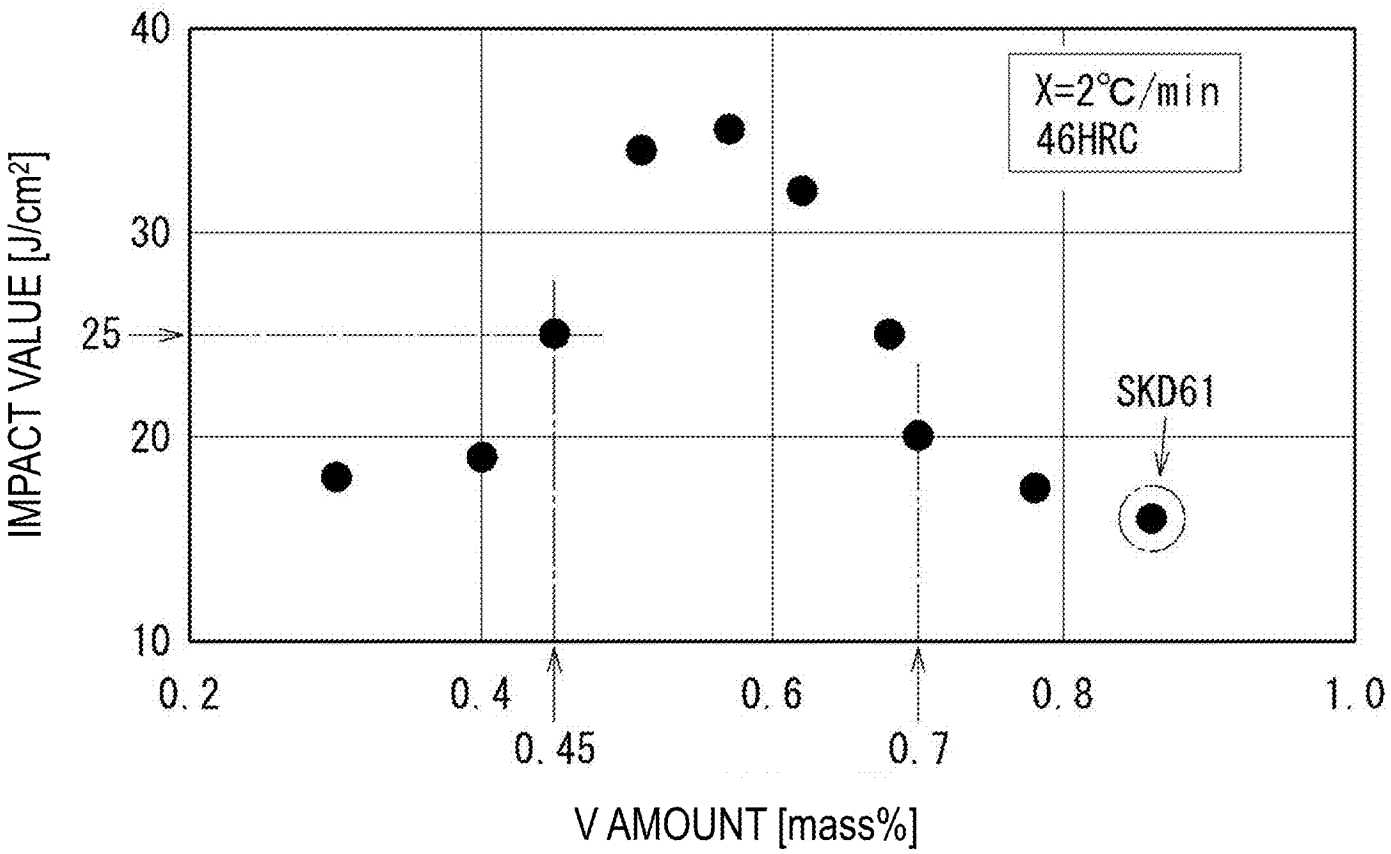
FIG. 7 is a graph showing the relationship between the V amount and the impact value.

In the following, from the viewpoint of impact value in the case where the cooling rate after hot working is small, the reasons for specifying the V amount are described. FIG. 7 shows impact values of total 9 types of steel materials prepared by changing the V amount of SKD61. The heat treatment process and conditions of the bar material as specimen of 12 mm×12 mm×55 mm were in accordance with FIG. 4, and the cooling rate after 1,250° C. heating was X=2° C./min. In the case where the amount of V was decreased from SKD61, the impact value rose. The condition for achieving the impact value of 20 J/cm$^2$ or more required for a die casting mold is V≤0.70. For this reason, the upper limit of V is set to 0.70%. Incidentally, the condition for satisfying the impact value of 25 J/cm$^2$ or more that is ideally required for a die casting mold, is V≤0.68.

In the case where the amount of V is further deceased from 0.7%, the impact value continues rising, but in the case where V becomes 0.5% or less, the impact value significantly decreases. The significant decrease occurs resulting from coarsening of crystal grains during quenching due to a decrease in the amount of pinning particles. In the case of V=0.45%, although an impact value of 25 J/cm$^2$ that is ideally required for a die casting mold is achieved in terms of the average value of 10 specimens, this is a region producing a pronounced variation in particle diameter due to small difference in the amount of pinning particles and in the case where the crystal grains are coarse, the impact value may become about 20 J/cm$^2$. For this reason, the lower limit of V is set to 0.45% where 20 J/cm$^2$ or more required for a die casting mold is stably obtained.

As described above, it was found that even in the case of X=2° C./min, the impact value can be highly stabilized by optimizing the Si amount and V amount. The cooling rate of 2° C./min corresponds to a cooling rate obtained in the case where a large block material with a thickness of 200 mm or more after hot working is rapidly cooled under the conditions not causing cracking or excessive thermal deformation.

Figure 8:
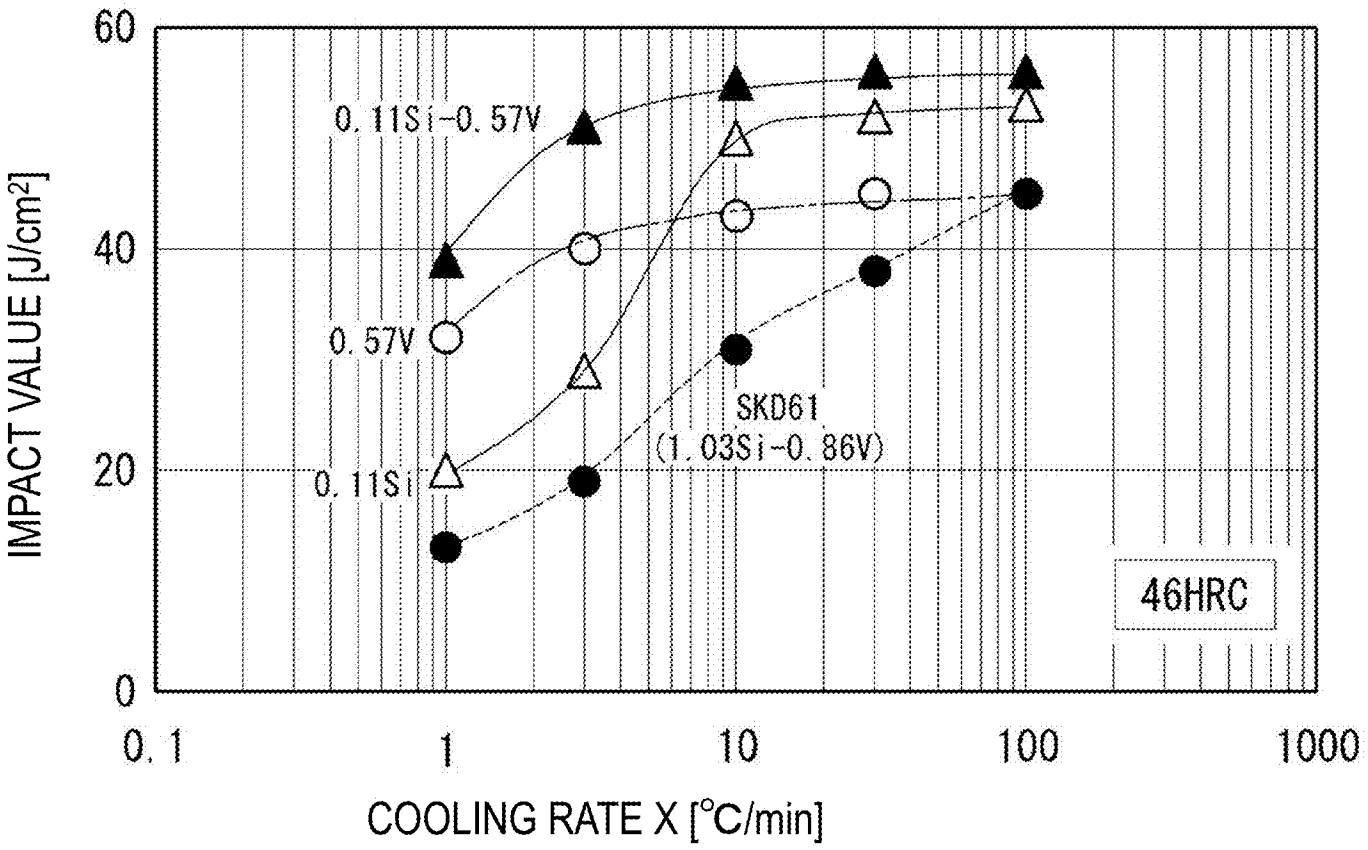
FIG. 8 is a graph showing a synergistic effect of Si and V on the impact value.

The synergistic effect of the Si amount and V amount and the effect of X are shown together in FIG. 8. The heat treatment process and conditions of the material as specimen of 12 mm×12 mm×55 mm were in accordance with FIG. 4. That is, the data of SKD61 in FIG. 8 is the same as that in FIG. 5. As for the sample (0.11Si steel) indicated by Δ where the Si amount of SKD61 (●) was reduced to 0.11%, the impact value at 10° C./min≤X is as large as 50 J/cm$^2$ or more and even in the case of X=2° C./min, the impact value of 25 J/cm$^2$ can be achieved. The effect due to a decrease in the Si amount was again confirmed.

Also, as for the sample (0.57V steel) indicated by ○ where the V amount of SKD61 (●) was reduced to 0.57%, the impact value at 6° C./min<X is lower than that of 0.11Si steel but at X≤6° C./min, is higher than that of 0.11Si steel, and thus, a high impact value of 30 J/cm$^2$ or more is obtained even at X=2° C./min. The effect due to a decrease in the V amount was again confirmed and at the same time, it was revealed that the effect due to the low V amount is pronounced in the case where X is small.

Furthermore, as for the sample (0.11Si-0.57V steel) indicated by ▲ where the Si amount and V amount of SKD61 (●) were reduced to 0.11% and 0.57%, respectively, a state having both advantages of the 0.11Si steel and 0.57V steel is attained, and a high impact value is obtained over a wide range of X. The impact value of the 0.11Si-0.57V steel is 39 J/cm$^2$ even at X=1° C./min, and this value is comparable with the impact value of 45 J/cm$^2$, which is the impact value of SKD61 in the case of X=100° C./min.

Figure 9:
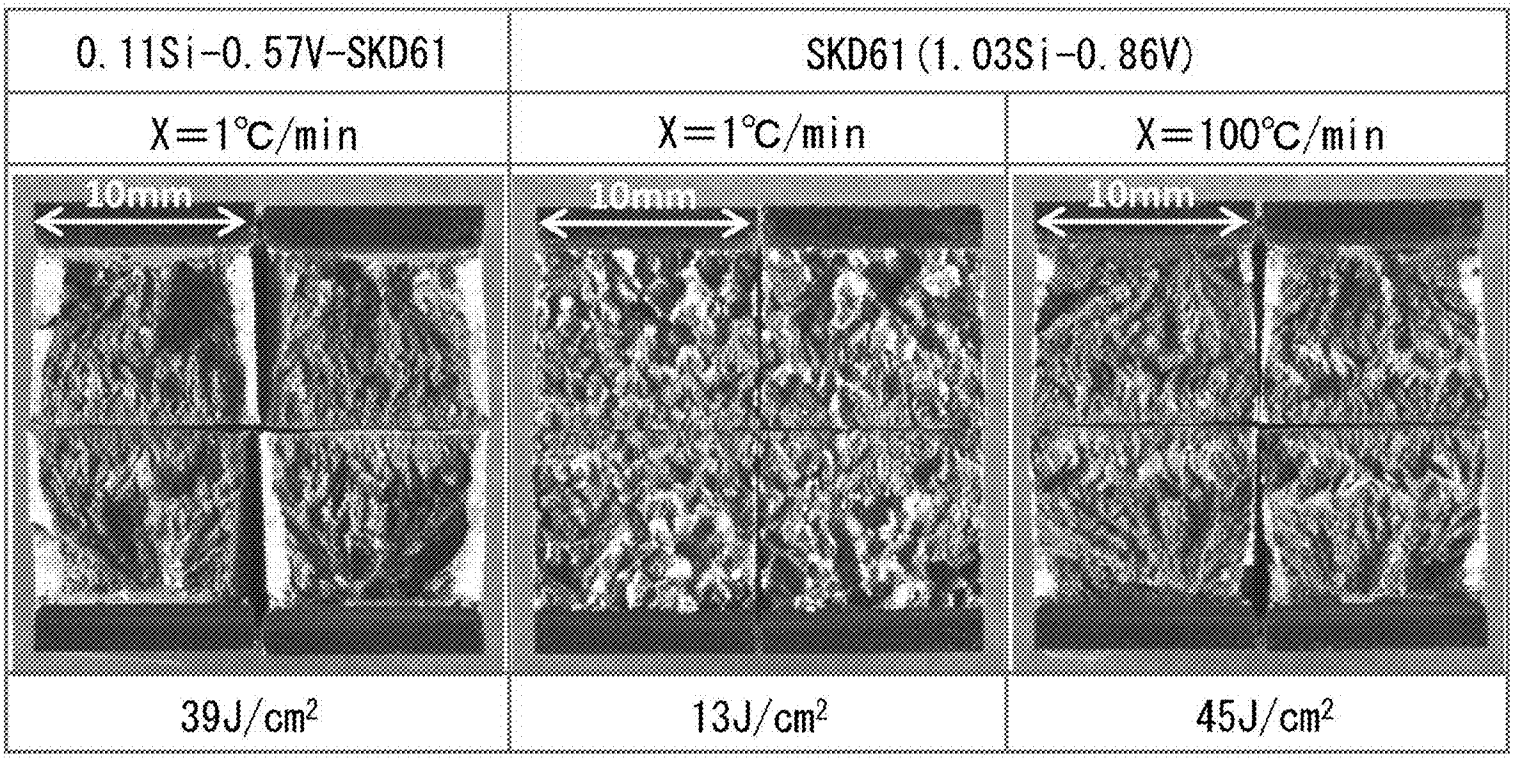
FIG. 9 includes photographs each showing the fracture surface state of an impact test specimen giving the impact value of FIG. 8.
Figure 10:
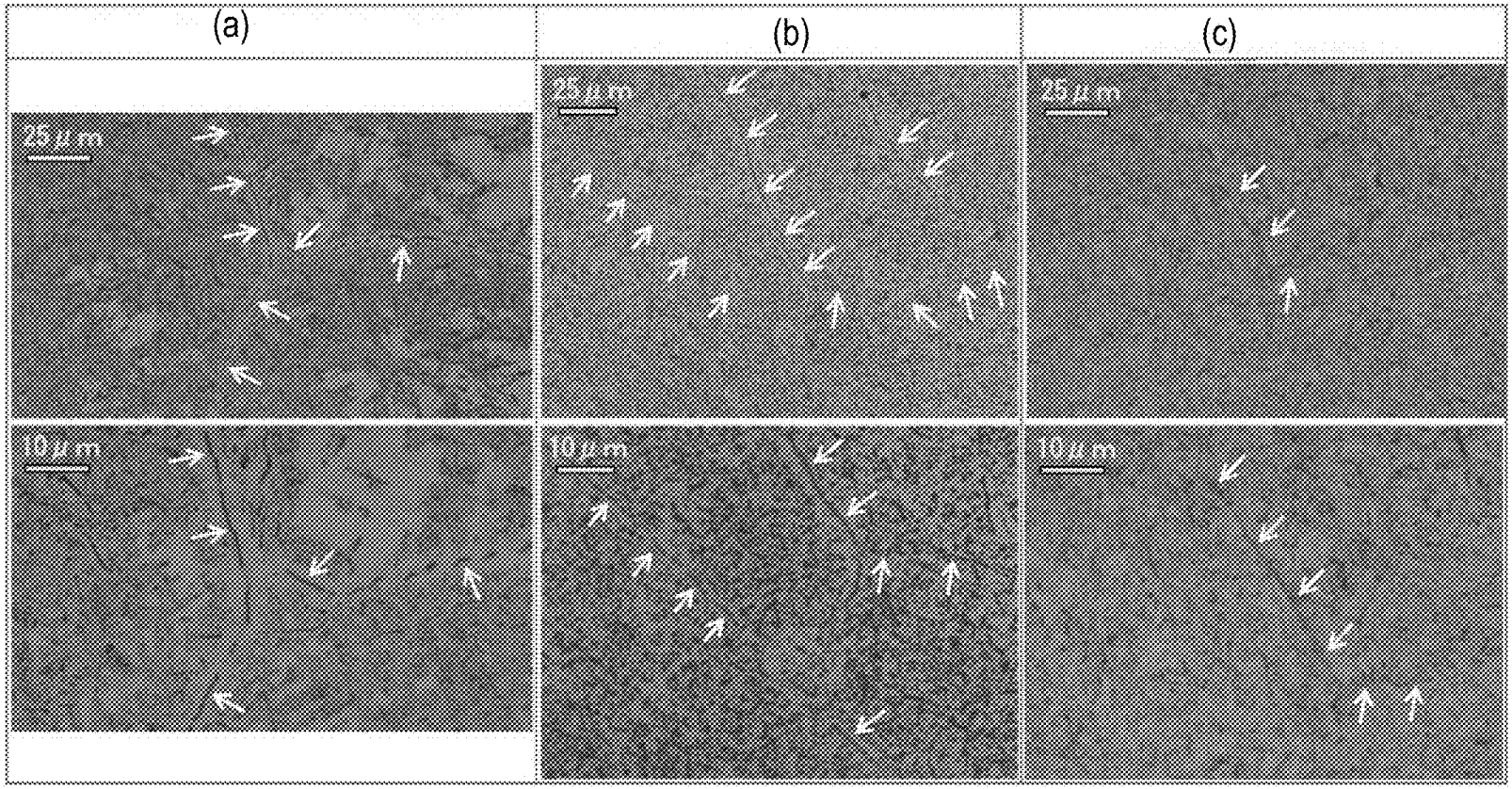
FIG. 10 includes micrographs each showing the microstructure during the process in SKD61 material cooled at X=1° C./min; (a) is a state after the material was heated at 1,250° C. and then cooled; (b) is a state after the material was normalized at 1,040° C. and then spheroidizing annealed; and (c) is a state after the material was quenched and tempered.

FIG. 9 shows fracture surfaces of specimens giving the impact values of FIG. 8. The photographs show states of, out of 10 specimens evaluated for each sample, two specimens, i.e., a specimen giving a highest impact value and a specimen giving a lowest impact value. The impact value described below photographs is an average value of 10 specimens. In the case of X=1° C./min in SKD61, SKD61 exhibits a fracture surface looking as if coarse crystal grains have dropped off. Since this coarse region served as a fracture surface unit, the impact value is low. On other hand, in the case of X=100° C./min in SKD61, even SKD61 exhibits a smooth fracture surface and has a high impact value. In the case of a steel where the Si amount and V amount of SKD61 are reduced to 0.11% and 0.57%, respectively, a similar fracture surface to that of SKD61 at X=100° C./min is exhibited even at X=1° C./min, and the impact value is high as well. In addition, 0.11Si-0.57V-SKD61 (0.11Si-0.57V steel) exhibits a preferable fracture surface where a shear lip has more developed than that in SKD61 at X=100° C./min Experiments shown in FIG. 8 and FIG. 9 were conducted while tracking the change in microstructure during process (states (a), (b) and (c) in FIG. 4). FIG. 10 shows states of SKD61 at X=1° C./min. Arrows point to carbides and indicate that carbides are distributed in a coarse network manner. Since carbides have been precipitated at austenite crystal grain boundaries during cooling to 600° C. after 1,250° C. heating, the distribution corresponds to the size of austenite crystal grains at the time of 1,250° C. heating. Then, carbides at the prior austenite crystal grain boundaries do not disappear even in the subsequent heat treatment and remain in the state (b) after SA as well as in the state (c) after quenching and tempering. The reason why in FIG. 9, SKD61 at X=1° C./min exhibits a fracture surface looking as if coarse crystal grains have dropped off is because the coarse carbide network served as a fracture surface unit.

Figure 11:
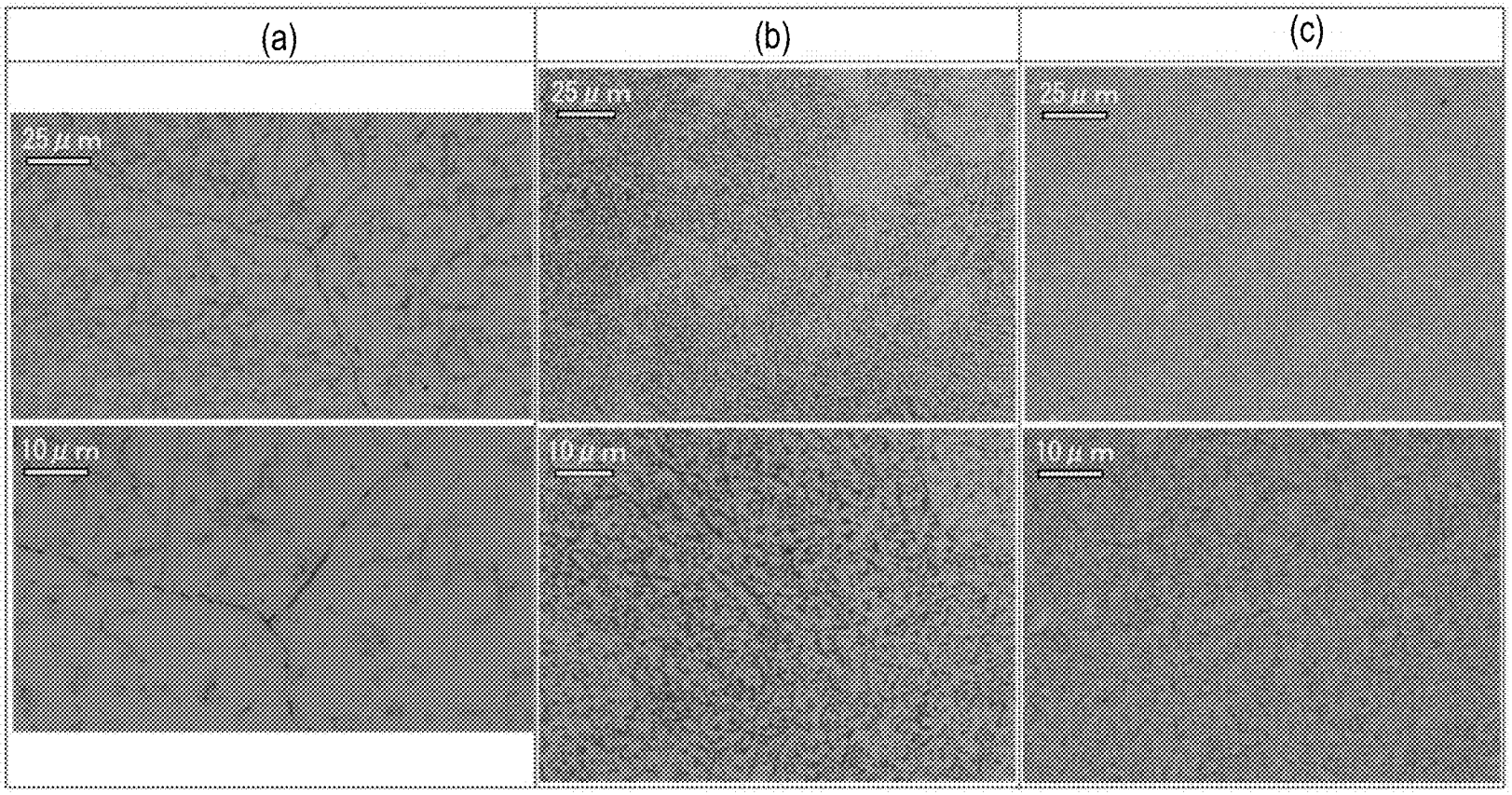
FIG. 11 includes micrographs each showing the microstructure during the process in SKD61 material cooled at X=100° C./min; (a) is a state after the material was heated at 1,250° C. and then cooled; (b) is a state after the material was normalized at 1,040° C. and then spheroidizing annealed; and (c) is a state after the material was quenched and tempered.

FIG. 11 shows states of SKD61 at X=100° C./min. Unlike FIG. 10, carbides distributed in a coarse network manner are scarcely observed. The reason why in FIG. 9, SKD61 at X=100° C./min exhibits a fine fracture surface is because due to absence of a coarse carbide network, fine austenite crystal grains at the time of 1,030° C. quenching served as a fracture surface unit. Consequently, the impact value was high.

In the case of SKD61, in order to reduce the precipitation of carbides at austenite crystal grain boundaries during cooling to 600° C. after 1,250° C. heating, the cooling rate X must be increased. On the other hand, in the case of the steel of the present invention where the Si amount and V amount are decreased, precipitation of carbides is suppressed even in the case where X is small, and a similar microstructure to FIG. 11 was obtained. Consequently, a high impact value is obtained even in the case where X is small (see, FIG. 8).

From the discussions above, it is clarified that even in the case where the cooling rate after hot working is small, if the amounts of Si and V are decreased, high impact value can be achieved stably. As long as Si≤0.35 and V≤0.70 are satisfied, an impact value (46 HRC) of 20 J/cm$^2$ or more can be ensured even at X=2° C./min.

Incidentally, it has been ascertained by a separate experiment that the temperature range where precipitation of carbides at austenite crystal grain boundaries occurs in the process of cooling to 600° C. from 1,250° C. heating simulating hot working is 1,000° C. or less. When applied to the industrial production process, it can be said that a cooling rate after the completion of hot working until a site (central part) that is cooled at the slowest rate in the steel material cross-section reaches 1,000° C. little affects the precipitation of carbides, whereas a cooling rate in the 400° C. section from 1,000° C. to 600° C. greatly affects the carbide precipitation (i.e., impact value).

Figure 12:
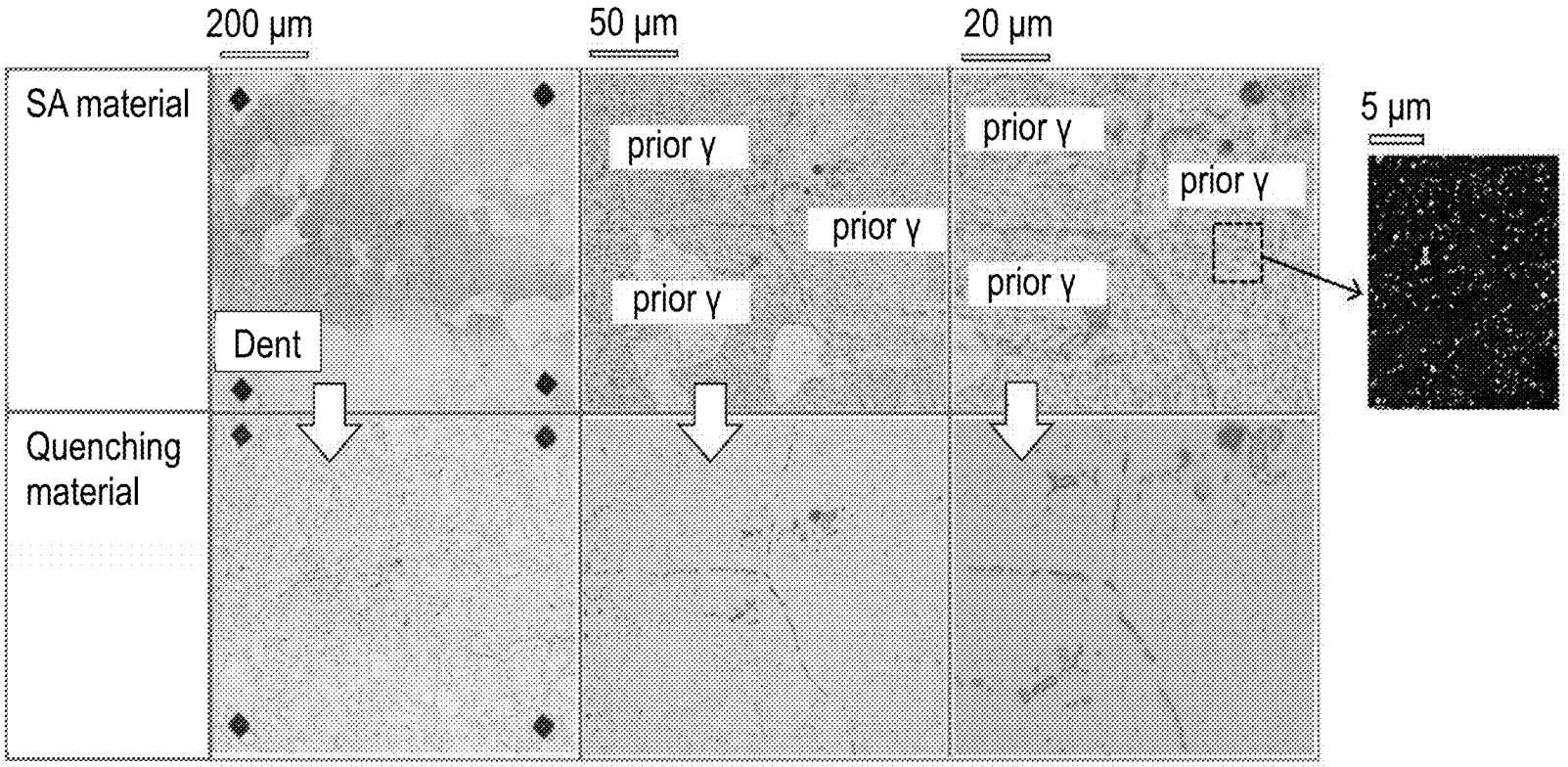
FIG. 12 includes micrographs showing the change in the carbide mode in SKD61 material cooled at X=1° C./min.

In the following, the mode of "carbides distributed in a coarse network manner", which reduces the impact value, is quantified. In FIG. 10 and FIG. 11, the states (a), (b) and (c) are not the same site, but different sites are observed in respective states. Also, since the state (c) is after tempering, carbides causing a problem are slightly indistinctive. Then, in order to get confirmation that "carbides distributed in a coarse network manner" of SA material (material after SA) remain after quenching, the same site was tracked before and after quenching. The results are shown in FIG. 12. The microstructure of SA material was observed in the state (b) of FIG. 4, an indenter for Vickers hardness measurement was pressed into a region of "carbides distributed in a coarse network manner", and the site to be tracked was marked by dents. The marks "•" at four corners of the top-left optical micrograph are dents.

In observing SA material while increasing the magnification (observing the upper photographs toward right side), three austenite (in FIG. 12, denoted as prior γ) crystal grains are observed in the view field of center and right photographs, and carbides form a discontinuous string in a dashed-line manner at grain boundaries of these austenite crystal grains at the time of SA. This is the problem "carbides distributed in a coarse network manner". Within the prior γ crystal grain, as seen in the far-right SEM photograph, fine carbides having an average particle diameter of less than 0.6 μm are dispersed in the ferrite matrix phase. Although it depends on the components or SA conditions, the average particle diameter of carbides is often from 0.15 μm to 0.30 μm. An appropriate SA microstructure is in this state throughout the microstructure and has none or a very small number of "carbides distributed in a coarse network manner".

Lower three photographs of FIG. 12 show the state where the microstructure is observed after SA material is quenched from 1,030° C., lightly polished while taking care not to cause disappearance of dents and then re-corroded. From the positions of dents in the bottom-left photograph, it is understood that the same site is observed before and after quenching. As shown in lower three photographs of FIG. 12, it was proved that the "carbides distributed in a coarse network manner" of SA material "remain even after quenching without greatly changing their mode".

Figure 13:
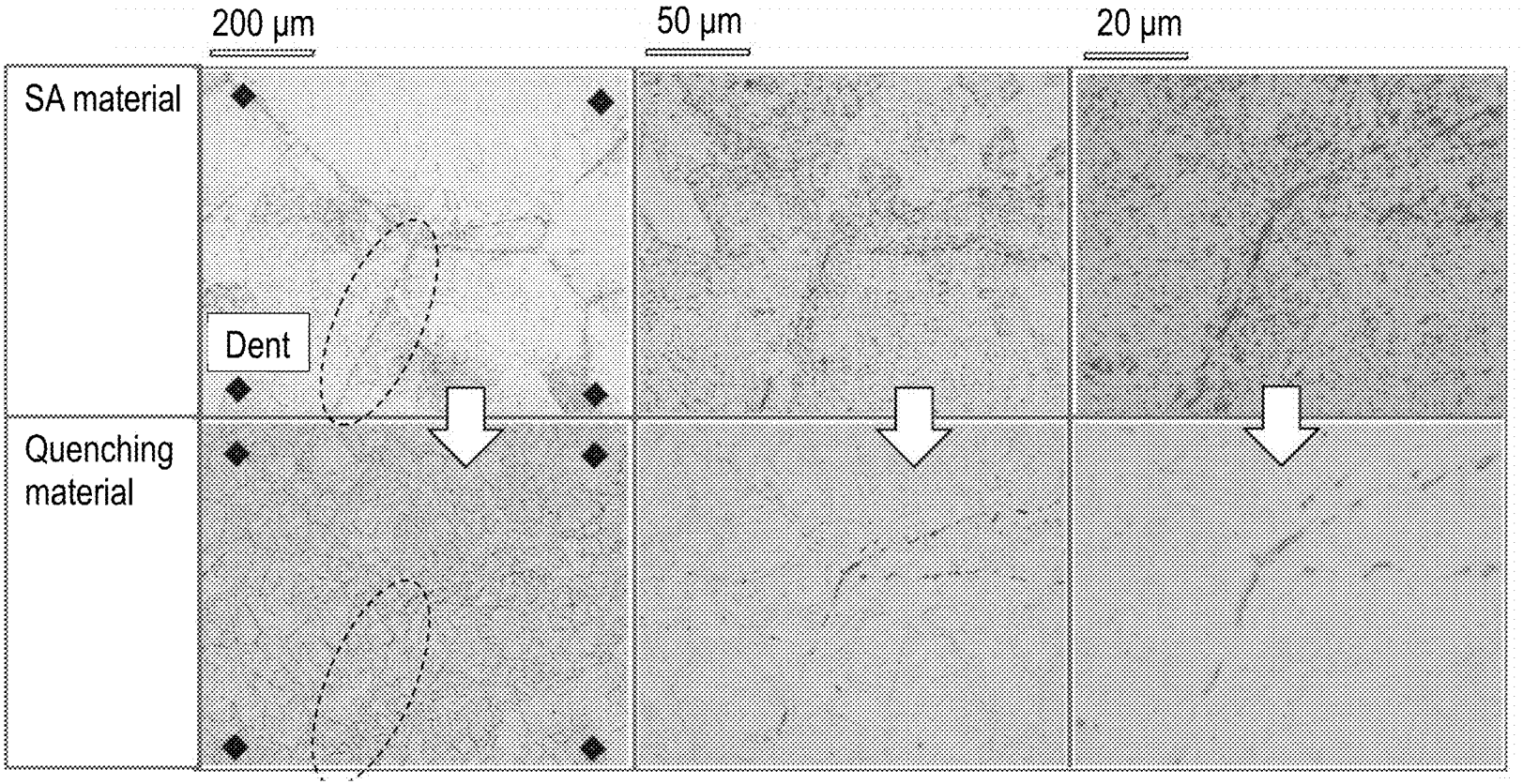
FIG. 13 includes micrographs showing the change in the carbide mode at a site different from FIG. 12.

In FIG. 13, despite a different site, it is apparent that, as with FIG. 12, "carbides distributed in a coarse network manner" of SA material "remain even after quenching without greatly changing their mode". Another feature is that the length of a linear or arc-shaped string where coarse carbides form a dashed-line-form discontinuous string extends 300 μm or more. In FIG. 13, the string is surrounded by a dashed line, and a schematic diagram of a network formed from such strings (i.e., a contour of austenite crystal grains) is FIGS. 3A to 3C. In addition, this network serves as a unit and makes the fracture surface in the impact test coarse (see, FIG. 9).

Figure 14:
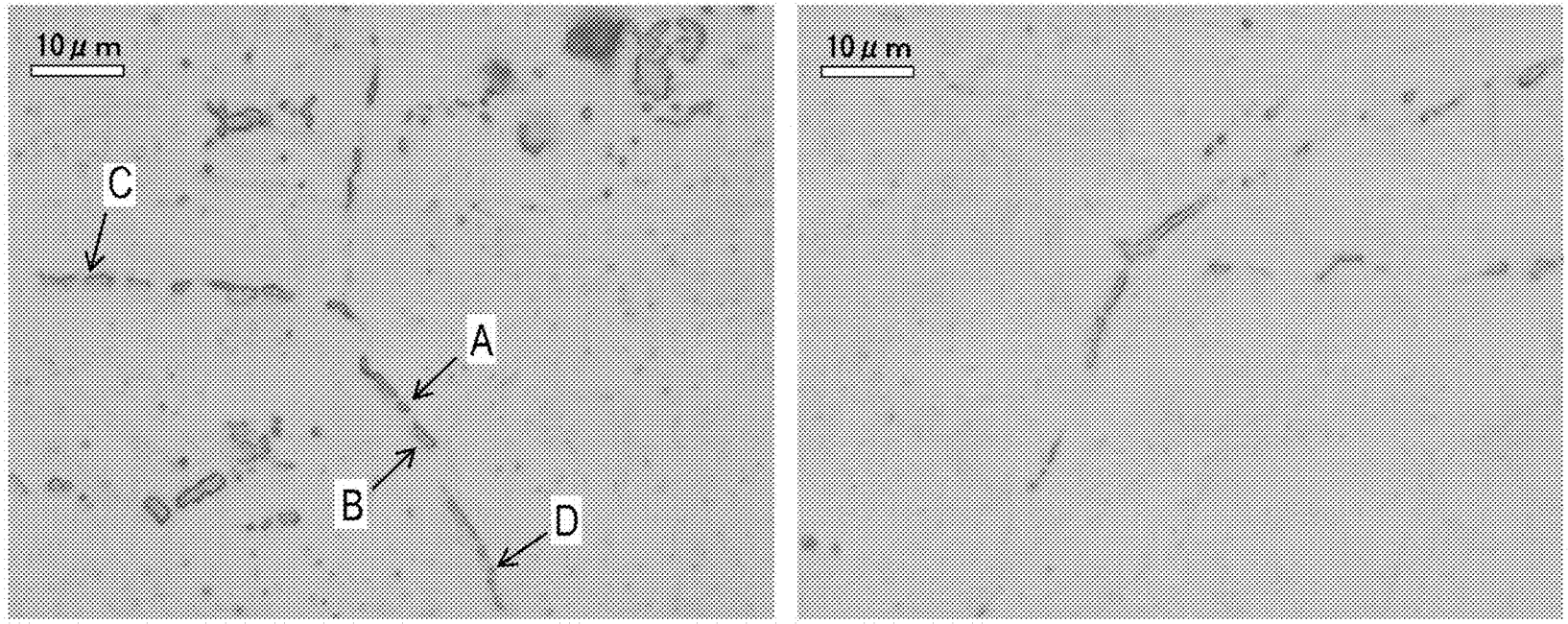
FIG. 14 includes micrographs enlargedly displaying carbides in quenched materials shown in FIG. 12 and FIG. 13.

As shown in FIG. 14, the "carbides distributed in a coarse network manner" are also individually large, and carbide A is 1.3 μm, carbide B is 3.0 μm, carbide C is 0.8 μm and carbide D is 0.6 μm. These are apparently large considering that fine carbides (the far-right photograph of FIG. 13) dispersed in the ferrite matrix phase of SA material and fine carbides dispersed in the austenite matrix phase at the time of quenching have a diameter of less than 0.6 μm. Moreover, such large carbides of 0.6 μm or more form a dashed-line-form discontinuous string at interval of 50 μm or less. The string is in a linear or arc shape and extends 300 μm or more. Carbides of less than 0.6 μm are included in the dashed-line-form discontinuous string in some cases.

Even in the case where austenite crystal grains at the time of quenching are as fine as 100 μm or less in terms of an average particle diameter, if large carbides of 0.6 μm or more form a dashed-line-form discontinuous string over 300 μm or more in a linear or arc-shaped manner at a distance of 50 μm or less, the string acts in fracture as if it is a crystal grain, and gives rise to a rough fracture surface and a low impact value. In the case where the dashed-line-form discontinuous string is short, the adverse effects, i.e., roughening of fracture surface and reduction in the impact value, are small. Accordingly, the dashed-line-form discontinuous string of carbides is preferably "a length of a dashed-line-form discontinuous string at intervals of 50 μm or less is less than 300 μm when the dashed-line-form discontinuous string is formed of carbides having a maximum length of 0.6 μm or more".

Here, the above-described size (length) of carbides means the maximum size (maximum length). This is a value evaluated in a direction where the carbide size is measured largest, and is a value on the long axis side in the case of an ellipse or bar shape. Similarly, in the case where the carbide is of a "dogleg" (or V-shaped) type, the size in which the projected length becomes maximum was simply evaluated. In addition, the interval in carbides having a maximum length of 0.6 μm or more means an interval in the state where the carbides of which maximum length is less than 0.6 μm are not taken into consideration (the interval δ illustrated in FIG. 3B).

Accordingly, it is preferable that the steel material contains no carbides having a maximum length of more than 0.3 μm, but if the steel material contains carbides having a maximum length of more than 0.3 μm, carbides forming a dashed-line-form discontinuous string at intervals of 50 μm or less has the maximum length of more than 0.3 μm and less than 0.6 μm, or a region where carbides having a maximum length of 0.6 μm or more form a dashed-line-form discontinuous string at intervals of 50 μm or less is less than 300 μm.

As described above, the mode of coarse carbides which should be avoided and the Si and V amounts for making precipitation of coarse carbides difficult are clarified. In the following, the contents of verification of the quenchability using Cr—Mn—Cu—Ni are discussed.

Cr≤6.00:

The problems of 6.00<Cr are as follows. The softening resistance decreases. The softening resistance corresponds to a strengthening mechanism, called dispersion strength, of a steel material, and as the number of fine particles dispersed is larger, the softening resistance increases (reduction in hardness is lessened). When exposed to high temperature of less than Ac1 transformation temperature, Cr carbide is more likely to be coarsened than Mo carbide or V carbide, and therefore, as the steel material has higher Cr amount, the softening resistance is more deteriorated. The Ac1 transformation temperature is a temperature at which a transformation from ferrite phase to austenite phase starts on a heating process of a steel. More specifically, the mold surface exposed to high temperature due to contact with a molten metal during use as a die casting mold is readily softened, and this softening results in a decrease in the high-temperature strength, which reduces the heat checking resistance as well. In addition, in the case of 6.00<Cr, the thermal conductivity greatly decreases, and the thermal stress increases, which also reduces the heat checking resistance. Furthermore, in the case where high Cr is introduced in the case of low Si, the machinability significantly decreases. The range is preferably Cr≤5.95 and more preferably Cr≤5.90.

The lower limit of the Cr amount is about 5.40%, but the lower limit of the Cr amount is determined according to the Mn amount specified by two kinds of parameters, i.e., "Mn/Cr" governing SA property and "Mn+Cr" governing quenchability. The Cr amount must be balanced with the softening resistance so as to enhance the SA property, quenchability and high-temperature strength. From the viewpoint of enhancing the SA property, it is preferable to contain 5.58% or more of Cr.

Mn/Cr≤0.155:

The problems of 0.155<Mn/Cr are as follows. The SA property deteriorates and in SA at a heating temperature exceeding Ac3 temperature, unless the cooling rate is set to be less than 10° C./H, the steel material is not softened to 100 HRB or less, as a result, the time taken for the SA process becomes long, which reduces the productivity. Also, in the case of coarse crystal grains, such an SA defect as in FIG. 1 and FIG. 2 tends to be generated even at a cooling rate of less than 10° C./H. The range is preferably Mn/Cr≤0.153 and more preferably Mn/Cr≤0.151.

In the following, the effect of Mn/Cr on the SA property is described. A square bar having a small cross-section was produced using a research-use small size ingot, and a specimen prepared from the square bar was subjected to a heat treatment step simulating an industrial manufacturing method (a material for molds, and a mold).

The steel material had main components of 0.37C-0.12Si-0.012P-0.0018S-0.08Cu-0.11Ni-2.36Mo-0.63V-0.023Al-0.020N, in which the Mn amount and Cr amount were systematically changed. From these steel materials, 150 kg-ingots were prepared, soaked and then hot-worked into square bars each having a thickness of 80 mm, a width of 85 mm and a length of 2,200 mm. The square bars were cooled to near room temperature and subjected to SA of heating to Ac3 temperature+25° C. and cooling to 620° C. at 15° C./H. The Ac3 temperature of each steel species has been grasped in advance by a separate experiment. The Ac3 temperature as used herein is a value obtained by heating at a rate of 200° C./H and is an average value of 10 specimens. From the square bar having a thickness of 80 mm, a width of 85 mm and a length of 2,200 mm, a specimen of 12 mm×12 mm×20 mm for SA property evaluation was prepared.

Figure 15:
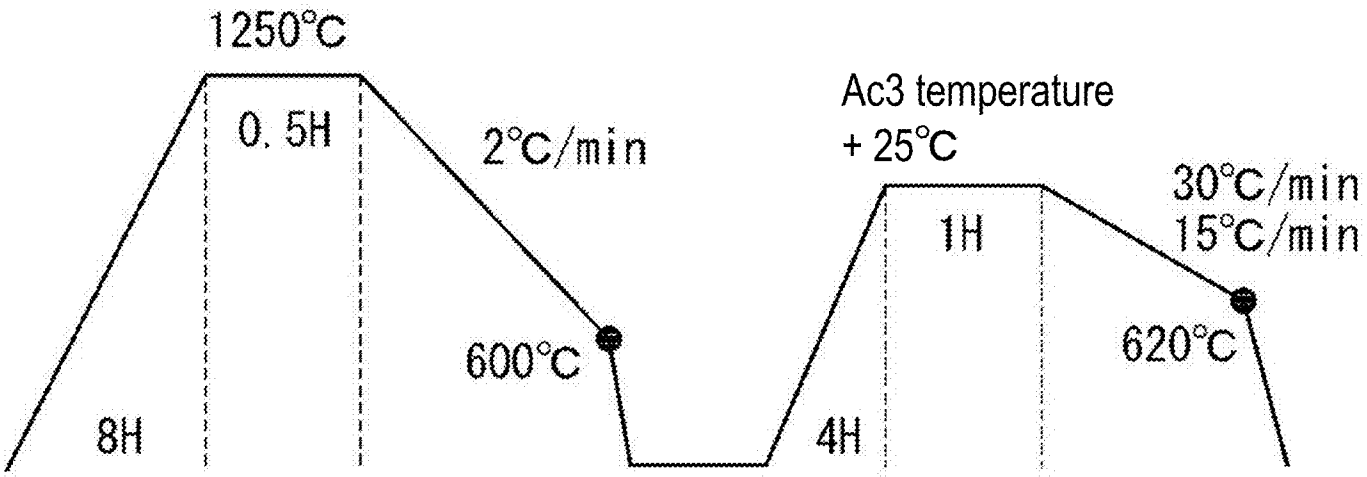
FIG. 15 is a diagram illustrating a heat treatment process at the time of examining the effects of Mn and Cr on the SA property.

The specimen was subjected to a vacuum heat treatment of FIG. 15 and evaluated for the SA property. Out of the production process "melting-refining-casting-homogenization heat treatment-hot working-(normalizing-tempering)-SA" of a steel material, the vacuum heat treatment of FIG. 15 simulated the hot working and subsequent steps, in which normalizing and tempering were omitted.

In addition, the cooling rate to 600° C. after 1,250° C. heating simulating hot working was set to 2° C./min. This corresponds to a case where a large block material with a thickness of 200 mm or more is rapidly cooled under conditions not causing cracking or excessive thermal deformation.

Figure 16:
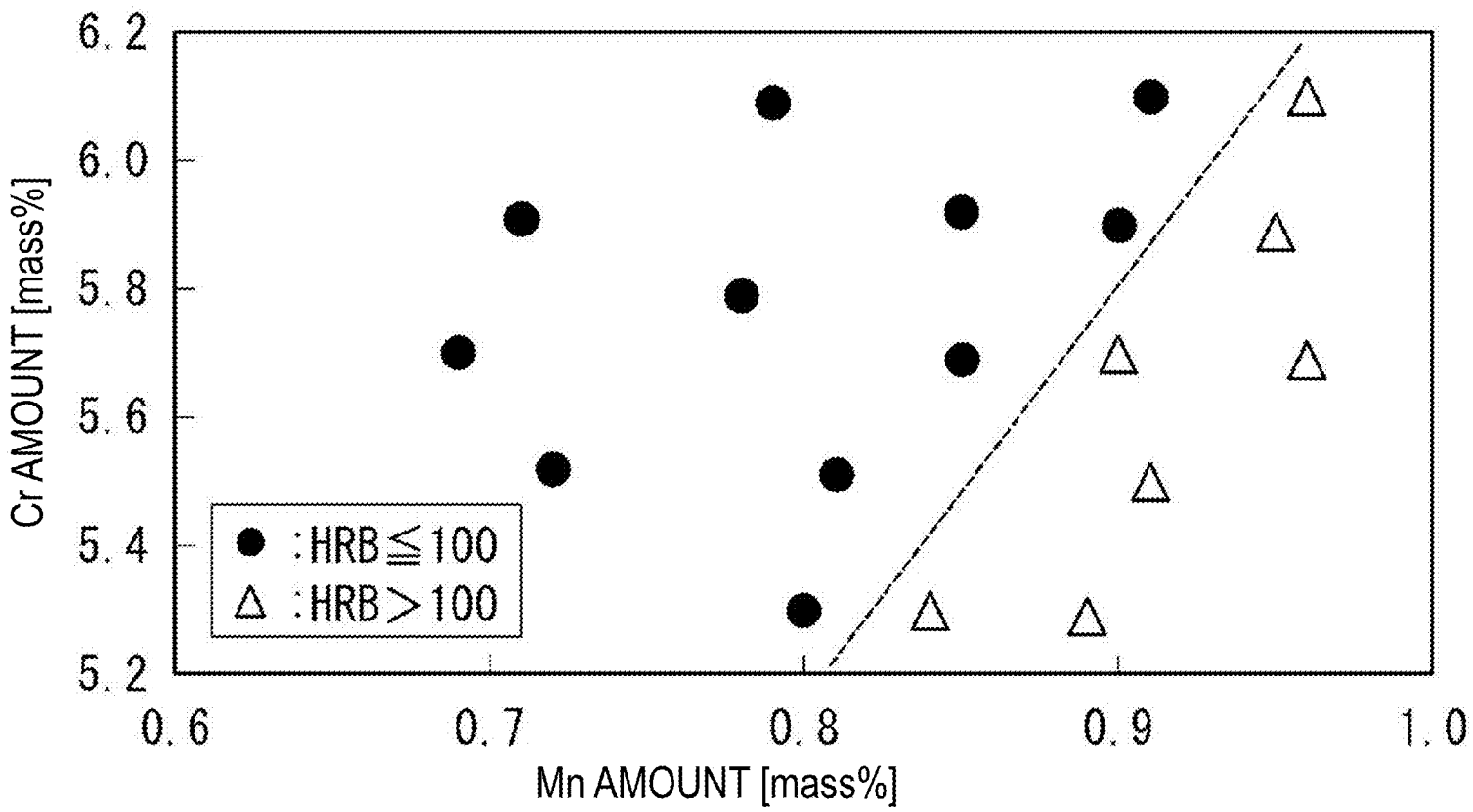
FIG. 16 is a graph showing the effects of Mn and Cr on the SA property.

The hardness of the specimen having passed through the process of FIG. 15 is shown in FIG. 16. In FIG. 16, each sample indicated by Δ is a hard level where the hardness exceeded 100 HRB, the SA property was poor and an SA defect as in FIG. 1 or FIG. 2 occurred. These results are attributed to the fact that untransformed austenite remaining at the time of cooling to 620° C. during the SA process was transformed into martensite or bainite. However, the area fraction of martensite or bainite was different depending on the level. Each sample indicated by ● is a level where the hardness was softened to 100 HRB or less, and the SA property was good.

In FIG. 16, the dashed line indicates Mn/Cr=0.155 corresponding to the boundary between the samples ● and the samples Δ, which is the ground for setting Mn/Cr≤0.155 in the present invention. As described above, the range is preferably Mn/Cr≤0.153, and in this range, even in the case where the cooling rate from Ac3 temperature+25° C. is increased to 18° C./H, softening to 100 HRB or less is achieved. The more preferable range is Mn/Cr≤0.151, and in this range, even in the case where the cooling rate from Ac3 temperature+25° C. is increased to 21° C./H, softening to 100 HRB or less is achieved. As Mn/Cr is smaller, softening is achieved at a larger cooling rate, and therefore, the efficiency of the heat treatment step is improved.

6.25≤Mn+Cr:

The problems of Mn+Cr<6.25 are as follows. The quenchability is insufficient, and the impact value significantly decreases especially inside a large mold. The range is preferably 6.27 Mn+Cr and more preferably 6.30 Mn+Cr.

In the following, the effect of Mn+Cr on the quenchability is described. Ten materials of 12 mm×12 mm×55 mm were prepared from a square bar with a thickness of 80 mm, a width of 85 mm and a length of 2,200 mm produced by the same production method as that in the case where the SA property was evaluated. The steel material had main components of 0.37C-0.12Si-0.012P-0.0018S-0.08Cu-0.11Ni-2.36Mo-0.63V-0.023Al-0.020N, in which the Mn amount and Cr amount were systematically changed.

Figure 17:
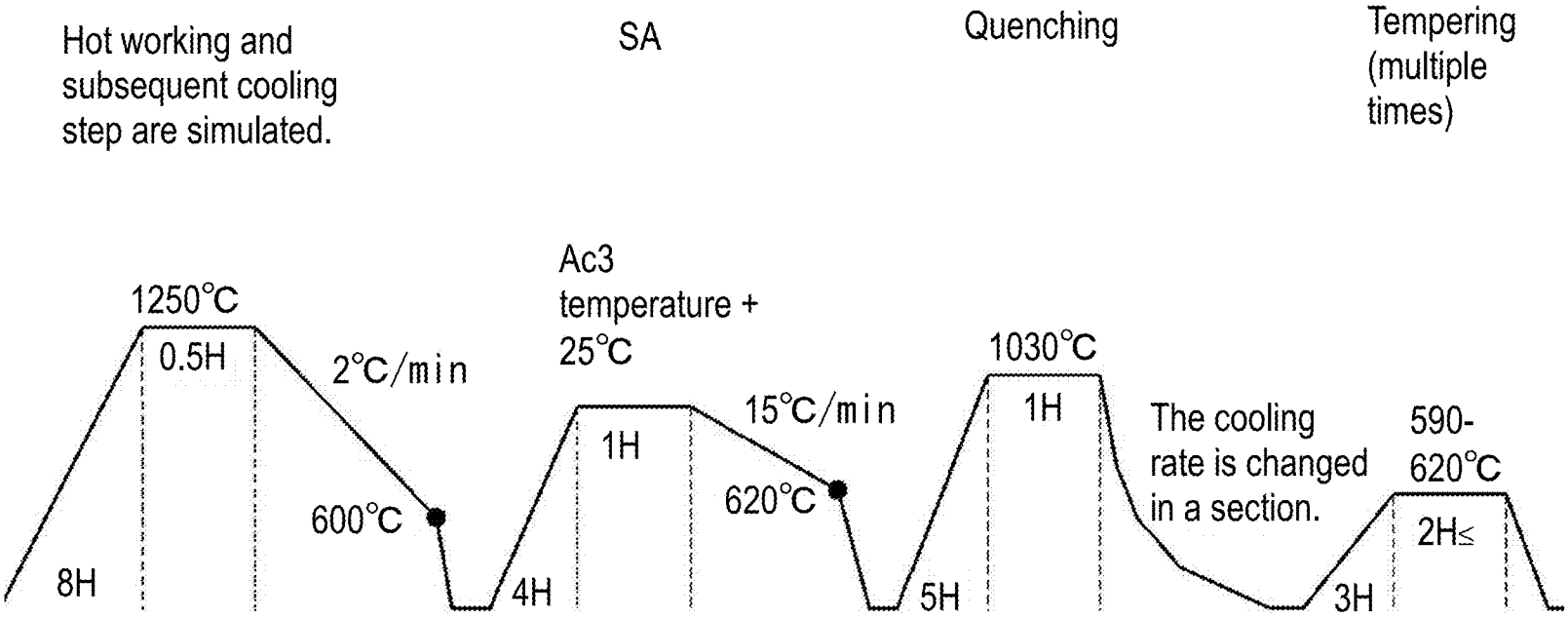
FIG. 17 is a diagram illustrating a heat treatment process at the time of evaluating the quenchability.
Figure 18:
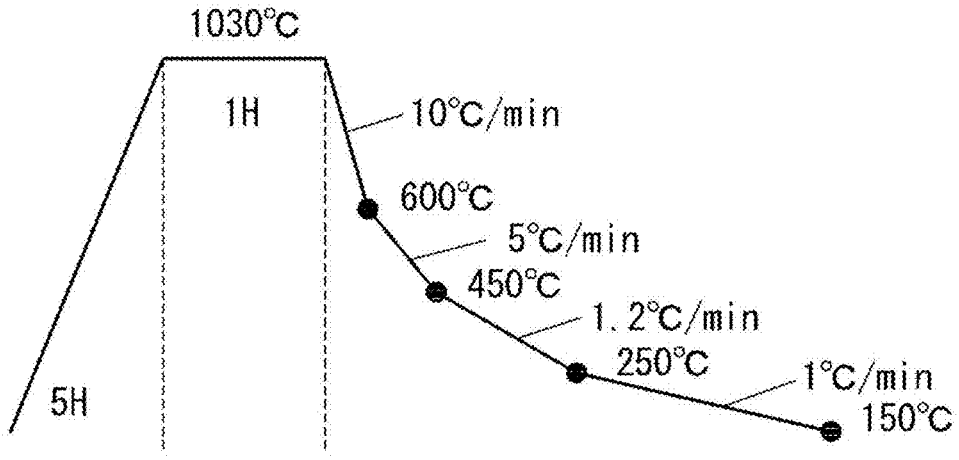
FIG. 18 is a diagram illustrating details of the controlled quenching of FIG. 17.

The materials prepared as above were subjected to a vacuum heat treatment of FIG. 17 and FIG. 18 and thermally refined to a hardness of 45.5 to 46.5 HRC. FIG. 17 illustrates the whole of the heat treatment process, and, out of the production process "melting-refining-casting-homogenization heat treatment-hot working-(normalizing-tempering)-SA" of a steel material, hot working and subsequent steps were simulated. Normalizing and tempering were omitted.

In FIG. 17, the process until SA corresponds to the "production of a material for molds". The cooling rate to 600° C. after 1,250° C. heating simulating hot working was set to 2° C./min. This corresponds to a case where a large block material with a thickness of 200 mm or more is rapidly cooled under conditions not causing cracking or excessive thermal deformation. Since the cooling rate to 1,000° C. little affects the grain boundary precipitation of carbides (i.e., the impact value) as described above, the cooling rate to 600° C. from 1,250° C. was set to 2° C./min so as to simplify the temperature control. Controlled quenching and tempering after SA correspond to thermal refining of a mold. FIG. 18 illustrates details of the controlled quenching and simulates a site that is cooled at the slowest rate in the mold cross-section in the case of quenching a large mold (conventionally, 300 kg or more). The cooling rate to 250° C. from 450° C., which greatly affects the impact value, was set to 1.2° C./min. The cooling rate to 250° C. from 450° C. of a large die casting mold is from 1.2° C./min to 10° C./min at a site that is cooled at the slowest rate in the mold cross-section.

Figure 19:
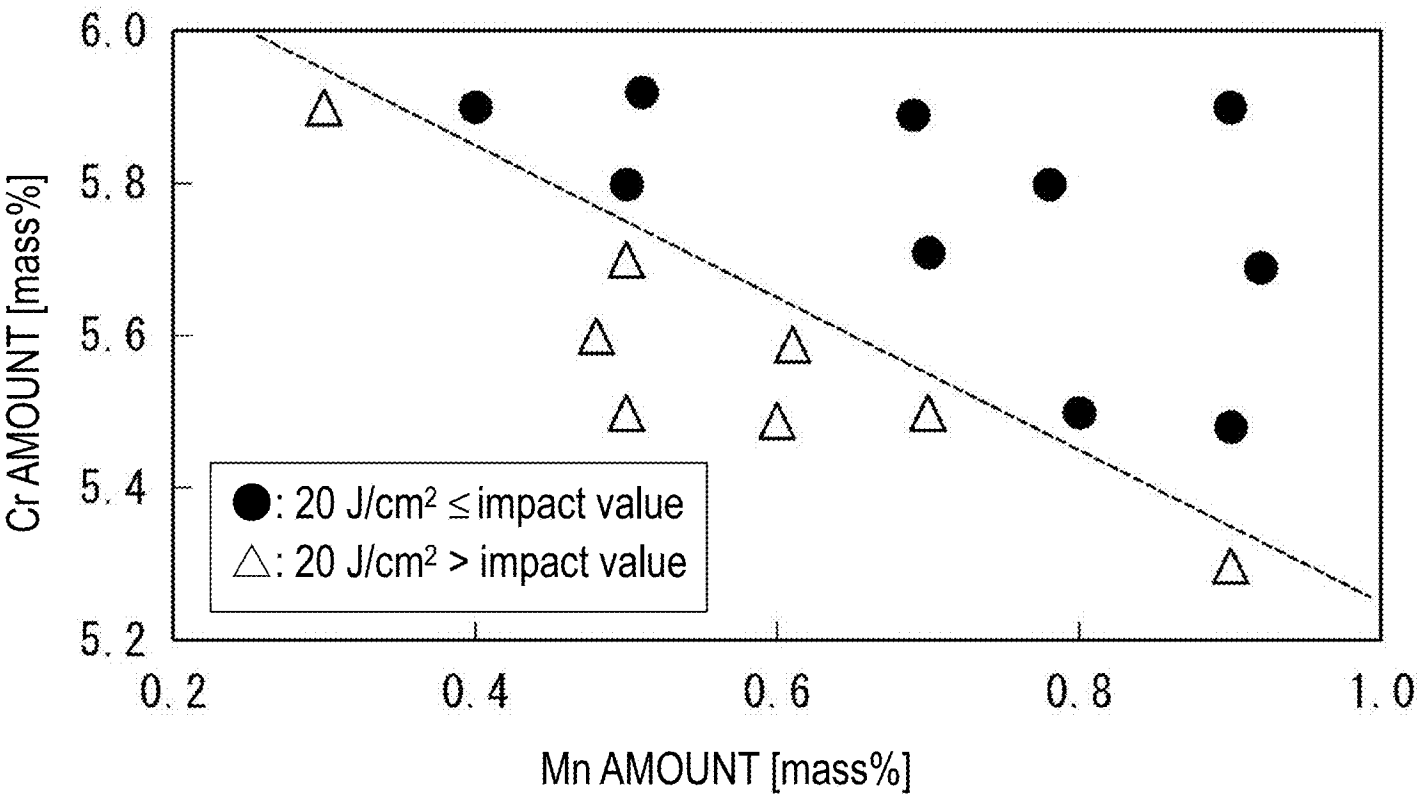
FIG. 19 is a graph showing the effects of Mn and Cr on the quenchability.

Specimen were prepared from the materials having passed through the process of FIG. 17 and FIG. 18 and evaluated for the impact value. The results are shown in FIG. 19 (46 HRC). In FIG. 19, each sample indicated by Δ is a level where the impact value was low as less than 20 J/cm$^2$, and the quenchability is poor. Each sample indicated by ● is a level where the impact value was high as 20 J/cm$^2$ or more, and good quenchability is achieved. In FIG. 19, the dashed line indicates Mn+Cr=6.25 corresponding to the boundary between the samples ● and the samples Δ, which is the ground for setting 6.25≤Mn+Cr in the present invention. As described above, the range is preferably 6.27≤Mn+Cr, and in this range, even in the case where the hardness is increased to a range of 46.5 HRC to 47.5 HRC, the impact value of 20 J/cm$^2$ or more is achieved. The more preferable range is 6.30≤Mn+Cr, and in this range, even in the case where the hardness is increased to a range of 47.5 HRC to 48.5 HRC, the impact value of 20 J/cm$^2$ or more is achieved. That is, as Mn+Cr is larger, the hardness enabling to obtain the impact value of 20 J/cm$^2$ or more becomes higher.

In order to avoid gross cracking, the die casting mold is required to have an impact value of 20 J/cm$^2$ or more. The impact value is inversely proportional to the hardness and therefore, the hardness must often be reduced to obtain a high impact value. The hardness very greatly affects the heat checking resistance, and if the hardness is low, the heat checking resistance deteriorates. That is, in the case where the hardness is decreased, the heat checking resistance deteriorates, whereas in the case where the hardness is increased, gross cracking is likely to occur. Accordingly, it is difficult to avoid gross cracking and achieve good heat checking resistance at the same time.

On the other hand, the steel material of the present invention where Mn+Cr is large, since the hardness enabling to obtain the impact value of 20 J/cm$^2$ or more is high, both resistance to gross cracking and good heat checking resistance are achieved. In FIG. 19, the position corresponding to JIS SKD61 (JIS G 4404:2015) is Mn=0.4 and Cr=5.0, and it is apparent that the quenchability of SKD61 is very low.

(Ranges of Cr and Mn)

Figure 20:
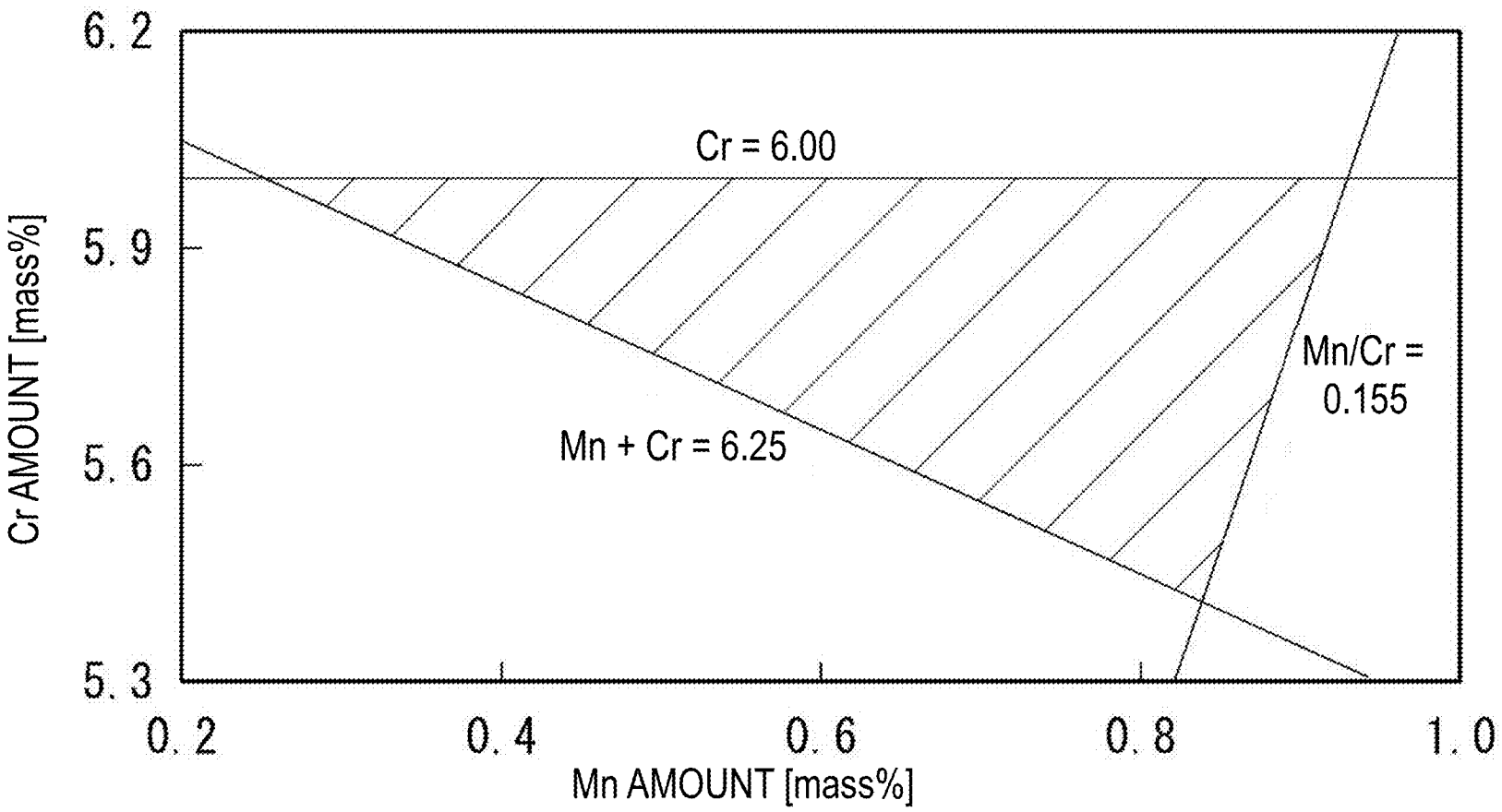
FIG. 20 is a graph showing appropriate ranges of the Mn amount and Cr amount.

As discussed in the description of Cr above, Cr≤6.00 is necessary in view of softening resistance. Also, from FIGS. 15 to 19, the effects of Cr and Mn on the SA property and quenchability are clarified. The ranges of Cr and Mn specified based on the information above are shown in FIG. 20. The triangle region surrounded by three solid lines (i.e., Cr=6.00, Mn+Cr=6.25, and Mn/Cr=0.155) is the scope of the present invention. Cr≤6.00, Mn/Cr≤0.155, and 6.25≤Mn+Cr are specified based on the softening resistance, SA property and quenchability, respectively. The Mn content is preferably 0.60≤Mn≤0.86, and more preferably 0.64≤Mn≤0.85. The Cr content is preferably 5.58≤Cr≤6.00, and more preferably 5.64≤Cr≤5.90. The "optimization of Cr and Mn" shown and illustrated in FIGS. 15 to 20 is a "second feature of the present invention". Due to introduction of parameters "Cr", "Mn+Cr", and "Mn/Cr", narrow ranges of Mn amount and Cr amount, where (1) SA property, (3) quenchability and (5) softening resistance are kept high, have been found. The (1) SA property and (3) quenchability, on which elements produce conflicting effects, are satisfied at the same time, and (3) quenchability and (5) softening resistance, on which elements produce conflicting effects, are also satisfied at the same time.

Cu+Ni≤0.84:

In the present invention, the (1) SA property, (3) quenchability and (5) softening resistance are ensured by the balance between Cr and Mn. Cu and Ni are effective in enhancing the quenchability but deteriorate the annealability and have little effect on the softening resistance. Their adverse effects are rather pronounced. Then, Cu and Ni are specified by using a range little affecting the quenchability and annealability, as the upper limit. The contents thereof are described below.

The index of the effect of an alloy element on increasing the quenchability of steel includes "quenchability characteristic value". As the numeral thereof is larger, the effect on increasing the quenchability is higher. The quenchability characteristic value is determined for each alloy element and its amount added. The quenchability of steel having different components is evaluated by the added value of quenchability characteristic values according to the types and amounts of alloy elements.

Here, the quenchability characteristic value of Mn with 0.10% addition is 0.125. On the other hand, the quenchability characteristic value of Ni with 0.42% addition is 0.062, and the quenchability characteristic value of Cu with 0.42% addition is also 0.062. More specifically, in the case where each of Cu and Ni is added in 0.42% (a total of 0.84% addition), the quenching characteristic value (added value) is 0.124, and this value is barely equivalent to 0.125 that is the quenchability characteristic value of Mn with 0.10% addition. That is, Cu+Ni≤0.84% has a small effect on the improvement of quenchability. Also, in the case where Cu+Ni is about 0.84%, the effect on the enhancement of high-temperature strength is small as well.

On the other hand, in the case where Cu+Ni is larger than 0.84%, various problems occur. Specifically, for example, cracking readily occurs at the time of hot working, the SA property deteriorates, or the cost rises. Consequently, this parameter is specified to be Cu+Ni≤0.84%. Since Mn+Cr ensuring the quenchability is 6.25% or more, it is apparent that Cu+Ni≤0.84% does not greatly affect the quenchability. In view of hot workability, SA property and cost, Cu+Ni is preferably 0.60% or less, and more preferably 0.39% or less.

(P, S and P+5S)

The machinability of a steel material is not so good in the case of Si≤0.35. Then, it is intended to improve the machinability by adding an appropriate amount of P so as to slightly embrittle the matrix material and adding an appropriate amount of S so as to slightly disperse MnS. The most important thing is to suppress a reduction in the impact value.

Ten materials of 12 mm×12 mm×55 mm were prepared from a square bar with a thickness of 80 mm, a width of 85 mm and a length of 2,200 mm produced by the same production method as that in the case where the SA property and quenchability were evaluated. The steel material had main components of 0.37C-0.11Si-0.75Mn-0.09Cu-0.09Ni-5.77Cr-2.36Mo-0.63V-0.023Al-0.019N, in which the P amount and S amount were systematically changed.

Figure 21:
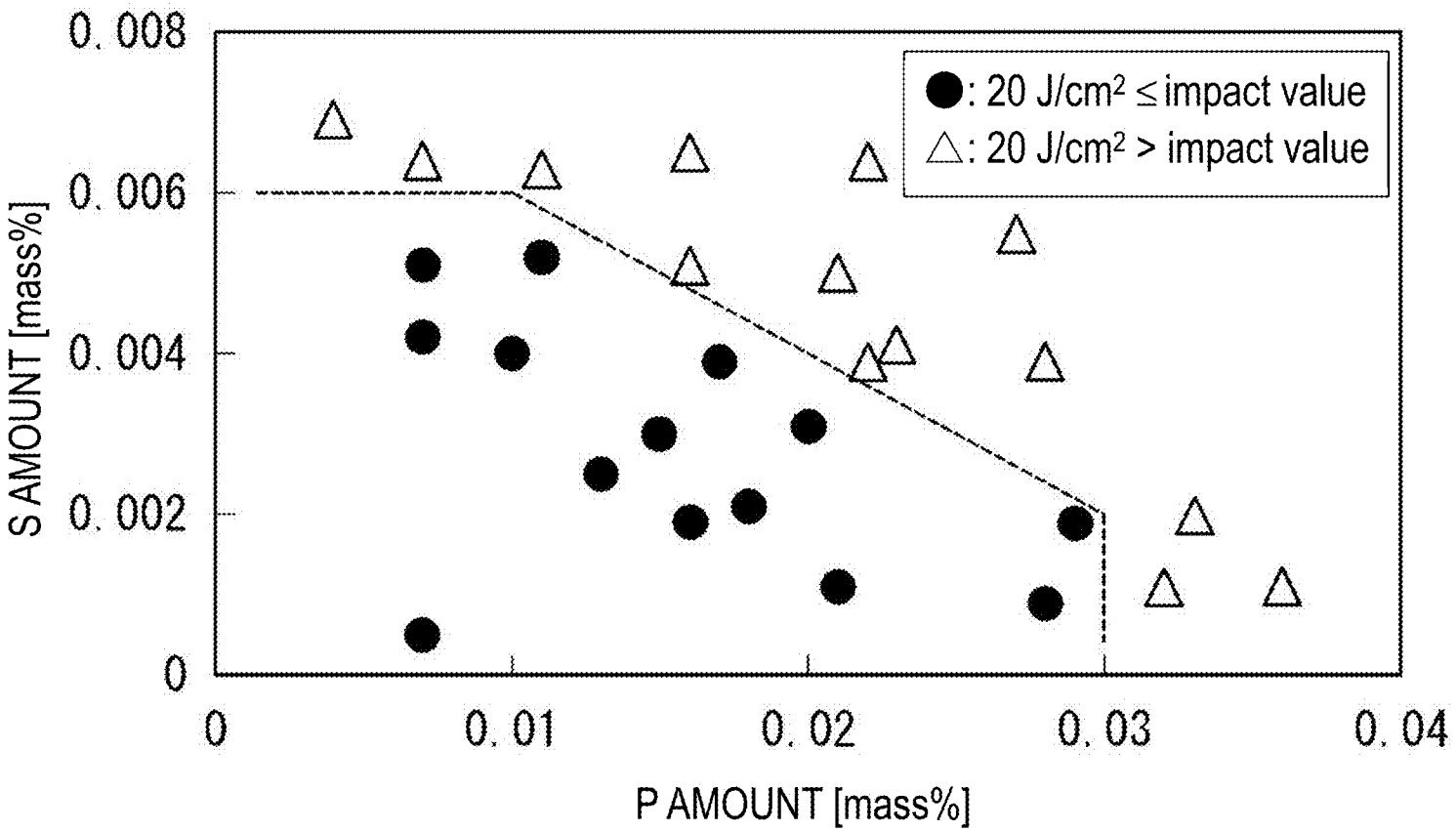
FIG. 21 is a graph showing the effects of P and S on the impact value.

The bar materials prepared as above were subjected to a vacuum heat treatment of FIG. 17 and FIG. 18 and thermally refined to a hardness of 45.5 HRC to 46.5 HRC. Specimens were prepared from the materials and evaluated for the impact value. The results are shown in FIG. 21 (46 HRC). In FIG. 21, each sample indicated by Δ is a level where the impact value was low as less than 20 J/cm$^2$, and each sample indicated by ● is a level where the impact value was high as 20 J/cm$^2$ or more. Although the steel of the present invention has a component system exerting a high impact value even at X=2.0° C./min and a small quenching rate corresponding to that of a large mold, but if the P and S amounts increase, the impact value of 20 J/cm$^2$ or more cannot be satisfied. The reason therefor is that since the amount of P segregated to the grain boundaries is increased due to increase in the P amount, embrittlement occurs and since the amount of MnS dispersed is also increased due to increase in the S amount, formation or propagation of cracks is facilitated.

In FIG. 21, the dashed line corresponds to the boundary between the samples ● and the samples Δ, which is adopted in the scope of the present invention. Specifically, P≤0.030, S≤0.0060, and P+5S≤0.040. Incidentally, the conditions satisfying the impact value of 25 J/cm$^2$ or more ideally required for a die casting mold are P≤0.020, S≤0.0040, and P+5S≤0.030.

Figure 22:
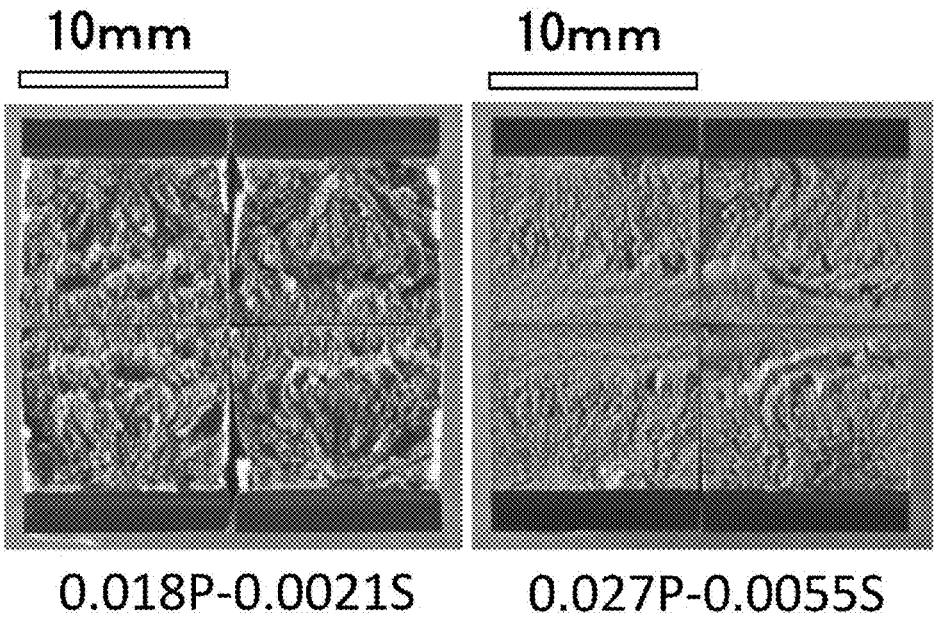
FIG. 22 includes photographs each showing the fracture surface state of an impact test specimen giving the impact value of FIG. 21.

FIG. 22 shows effects of P and S on the fracture surface state of an impact test specimen. The fracture surface of 0.018P-0.00215 has conspicuous unevenness, suggesting that cracks have developed while changing the direction. Consequently, 0.018P-0.0021S has a high impact value. On the other hand, the fracture surface of 0.027P-0.0055S is flat, suggesting that resistance to propagation of cracks is little. Therefore, 0.027P-0.0055S has a low impact value.

0.002≤P≤0.030:

The problems of P<0.002 are as follows. A high-purity raw material must be used and in turn, the production cost of a steel material rises.

The problems of 0.030<P are as shown in FIG. 21, and not only the impact value but also the fracture toughness value or ductility are reduced. In addition, the anisotropy of various properties increases. The anisotropy means a state where the property varies depending on the direction in which the specimen is sampled from the material. The range is preferably 0.002≤P≤0.025 and more preferably 0.003≤P≤0.020.

0.0003≤S≤0.0060:

The problems of S<0.0003 are as follows. A high-purity raw material must be used and in turn, the production cost of a steel material rises.

The problems of 0.0060<S are as shown in FIG. 21, and not only the impact value but also the fracture toughness value or ductility are reduced. In addition, the anisotropy of various properties increases. The range is preferably 0.0003≤S≤0.0050 and more preferably 0.0004≤S≤0.0040.

P+5S≤0.040:

The range is preferably P+5S≤0.035 and more preferably P+5S≤0.030.

2.03<Mo<2.40:

The problems of Mo≤2.03 are as follows, the softening resistance and high-temperature strength are insufficient, and the heat checking resistance is poor.

The problems of 2.40≤Mo are as follows. The machinability decreases. Especially, in the case where the Si amount is small, a pronounced decrease of machinability is caused. In addition, in the case of 2.40≤Mo, the fracture toughness decreases. This tendency is pronounced in the case where the Si amount is large. Furthermore, since Mo compound as a raw material is expensive, an excessive increase in the Mo amount brings about rise in cost. The range is preferably 2.05≤Mo≤2.39 and more preferably 2.07≤Mo≤2.38.

0.001≤Al≤0.050:

In the steel material of the present invention, the amount of V is specified to be 0.70% or less so as to obtain a high impact value even in the case where the cooling rate after hot working is small. Consequently, the amount of V carbides, carbonitrides or nitrides acting as a pinning particle at the time of quenching heating is smaller than that in SKD61. Then, Al is contained in the range of 0.001≤Al≤0.050, and AlN particles are used in combination for the growth suppression of austenite crystal grains.

The problems of Al<0.001 are as follows. It is difficult to reduce the oxygen content during refining, and this causes an increase in the oxide content and a decrease in the impact value. The amount of AlN acting as a pinning particle runs short, and austenite crystal grains are coarsened at the time of quenching heating, as a result, the impact value, fracture toughness value or ductility deteriorates.

The problems of 0.050<Al are as follows. Coarse alumina particles are increased, and the impact value or fatigue strength decreases. The thermal conductivity decreases, and the heat checking resistance becomes low. The range is preferably 0.002≤Al≤0.045 and more preferably 0.003≤Al≤0.040. Incidentally, in the case of adding Ca so as to improve the machinability, the Al amount is very important in terms of optimizing the compound mode.

0.003≤N≤0.050:

In order to disperse AlN particles in the austenite phase at the time of quenching heating, the N amount is specified together with the Al amount.

The problems of N<0.003 are as follows. The amount of AlN acting as a pinning particle runs short, and austenite crystal grains are coarsened at the time of the quenching heating, as a result, the impact value, fracture toughness value or ductility is deteriorated. In addition, the amount of V carbonitrides or nitrides that are a pinning particle as well also runs short.

The problems of 0.050<N are as follows. Due to exceeding the N amount that is adjustable by normal refining, active addition of N using dedicated equipment is necessary, and the material cost rises. In addition, the amount of a coarse crystallized product increases. This tendency is pronounced in the case where the C amount, Si amount and V amount are large. Furthermore, the amount of coarse AlN is excessively increased, and the impact value decreases. The range is preferably 0.004≤N≤0.045 and more preferably 0.005≤N≤0.040.

In the above descriptions, basic components of the steel material in the present invention have been described, but in the present invention, the following elements may be appropriately contained as needed.

0.30<W≤2.00, 0.30<Co≤1.00:

In the steel material of the present invention, the amounts of Mo and V are lower than those in commercially available high-performance steel and therefore, the strength is insufficient depending on use. Then, for increasing the strength, it is effective to add at least one element selected from the group consisting of W and Co. With respect to both elements, addition in excess of the above-mentioned range invites a rise in the material cost and leads to deterioration of the mechanical property or increased anisotropy due to pronounced segregation.

0.0002<B≤0.0080:

In the case where the content of P is high, P segregated at grain boundaries reduces the grain boundary strength, and the impact value decreases. For improving the grain boundary strength, addition of B is effective. Unless B exists alone (without forming a compound) in the steel, the effect of improving the grain boundary strength is not exerted. That is, if B forms BN, the addition of B is meaningless. Then, at the time of adding B to N-containing steel, N must be combined with an element except for B. Specifically, N is made to combine with an element that is likely to form a nitride, such as Ti, Zr or Nb. Such an element is effective even at an amount of impurity level, but if it is insufficient, they may be added in the amounts described below. Incidentally, in the case of intending to disperse BN for improving the machinability, it is not necessary to take a measure for actively combining N with a nitride-forming element.

0.004<Nb≤0.100, 0.004<Ta≤0.100, 0.004<Ti≤0.100, 0.004<Zr≤0.100:

In order to obtain a high impact value even in the case where the cooling rate after hot working is small, in the steel material of the present invention, the V amount is specified to be 0.70% or less. Consequently, the amount of V carbides, carbonitrides or nitrides acting as a pinning particle during quenching heating is smaller than that in SKD61. MN can be also used as a pinning particle in combination, but in a high-temperature and long-time quenching heating, austenite crystal grains are still likely to grow excessively. Then, the amount of carbides, nitrides or carbonitrides may be increased to thereby suppress the grain growth. Specifically, at least one element selected from the group consisting of Nb, Ta, Ti, and Zr may be added. With respect to all of these elements, in the case where they are added in excess of the above-mentioned range, carbides, carbonitrides or nitrides are crystallized in a coarse state during solidification in casting, and do not disappear even in homogenization heat treatment, SA or quenching, giving rise to a reduction in the impact value or fatigue strength. In addition, a rise in the material cost is caused.

0.0005<Ca≤0.0500, 0.03<Se≤0.50, 0.005<Te≤0.100, 0.01<Bi≤0.50, 0.03<Pb≤0.5:

The steel material of the present invention is a high Cr steel having a not-so large Si amount and therefore, its machinability may be insufficient depending on the cutting conditions. For improving the machinability, it is effective to add at least one element selected from the group consisting of Ca, Se, Te, Bi, and Pb. In the case where these elements are added in excess of the above-mentioned range, there arise such a problem that cracking readily occurs during hot working or the impact value or fatigue strength, etc. is reduced.

Here, in the steel material of the present invention, the balance except for elements above is Fe and unavoidable impurities. The components described below may be contained as unavoidable impurities.

For example, they are O≤0.005, W≤0.30, Co≤0.30, B≤0.0002, Nb≤0.004, Ta≤0.004, Ti≤0.004, Zr≤0.004, Ca≤0.0005, Se≤0.03, Te≤0.005, Bi≤0.01, Pb≤0.03, Mg≤0.02, etc. In a steel material, segregation inevitably exists, and the element amounts above are not a value obtained by analyzing (with EPMA, etc.) a very narrow region like a segregation part but are an "average element content of the steel material" derived from a chemical analytical method in which a steel material with a certain volume, including a strong segregation portion, a weak segregation portion and a middle segregation portion is melted in an acid.

(Manufacturing Method)

The steel material of the present invention can be manufactured through respective steps of melting-refining-casting-homogenization heat treatment-hot working-normalizing-tempering-spheroidizing annealing.

In the melting, refining and casting, raw materials blended to provide predetermined composition are melted, and the molten metal is cast into a mold to obtain an ingot.

In the homogenization heat treatment, the components of the obtained ingot are homogenized. The homogenization heat treatment is usually performed by holding the ingot at 1,150 to 1,350° C. for approximately from 10 to 30 hours.

In the hot working, the ingot is subjected to plastic working such as forging at 1,150 to 1,350° C. and is thereby formed into a predetermined shape. After the completion of hot working into a predetermined shape, the formed material is slowly cooled while avoiding rapid cooling. Here, in the case of cooling a large steel material having a thickness of 200 mm or more, a width of 300 mm or more and a length of 2,000 mm or more, from the viewpoint of suppressing the generation of "carbides distributed in a coarse network manner", the cooling rate to 600° C. from 1,000° C. at a site that is cooled at the slowest rate in the steel material cross-section is preferably set to 2° C./min or more.

Incidentally, as for the method when cooling the steel material, any one of cooling by forcedly applying air or inert gas to the steel material, cooling by immersing the steel material in a liquid of 230° C. or less, and cooling by placing the steel material in a constant-temperature bath at 300° C. to 600° C., can be used. In addition, these cooling methods may also be used in combination.

The spheroidizing annealing is preferably performed such that the hardness of the steel material becomes 260 Hv or less in terms of Vickers hardness. The spheroidizing annealing is performed by applying the above-described slow cooling method, etc. to a "microstructure where carbides are dispersed in an austenite phase and the ferrite phase fraction is very small or nil", which is obtained by heating the steel material in a furnace in a temperature range of the Ac3 temperature minus 10° C. to the Ac3 temperature plus 50° C., as described above.

Incidentally, it is also possible to appropriately conduct normalizing or tempering, between hot working and spheroidizing annealing, for the purpose of, e.g., making crystal grains fine or softening the material.

Then, in the present invention, a mold can be manufactured using the steel material above through an HT process that is performed in order of "rough working (machining into a rough mold shape)-quenching-tempering-finish machining-surface modification".

The rough working is performed by machining a softened material (steel material) into a predetermined shape.

The quenching and tempering are performed so that the roughly worked material can have a desired hardness. As for each of the quenching conditions and the tempering conditions, optimal conditions are preferably selected according to the components and required properties. The quenching is usually performed by subjecting the material to holding at 1,000 to 1,050° C. for 0.5 to 5 hours and then to rapid cooling. The tempering is usually performed by holding at 580 to 630° C. for 1 to 10 hours. The tempering can be conducted a plurality of times so as to obtain a predetermined hardness.

The surface modification after finish machining includes two types. The first type is a treatment of forming a layer or film having differing components from the steel material by nitridation or Physical Vapor Deposition (PVD), etc. The second type is a treatment of introducing residual stress, changing the surface roughness, imparting unevenness to the surface, by shot peening or spark deposition, etc. The surface modification is sometimes omitted.

EXAMPLES

Next, Examples of the present invention are described below. Here, the steel material properties are verified using a test-size small ingot but not an industrial large-size (1,000 kg or more) ingot. In the verification of the steel material properties, the performances when used in practice are accurately determined by simulating the industrial process.

The targets are 29 steel species in total of Examples and Comparative Examples shown in Table 1 below. As the category of steels, all of them are 5.0-6.5Cr hot die steel.

Figure 2:
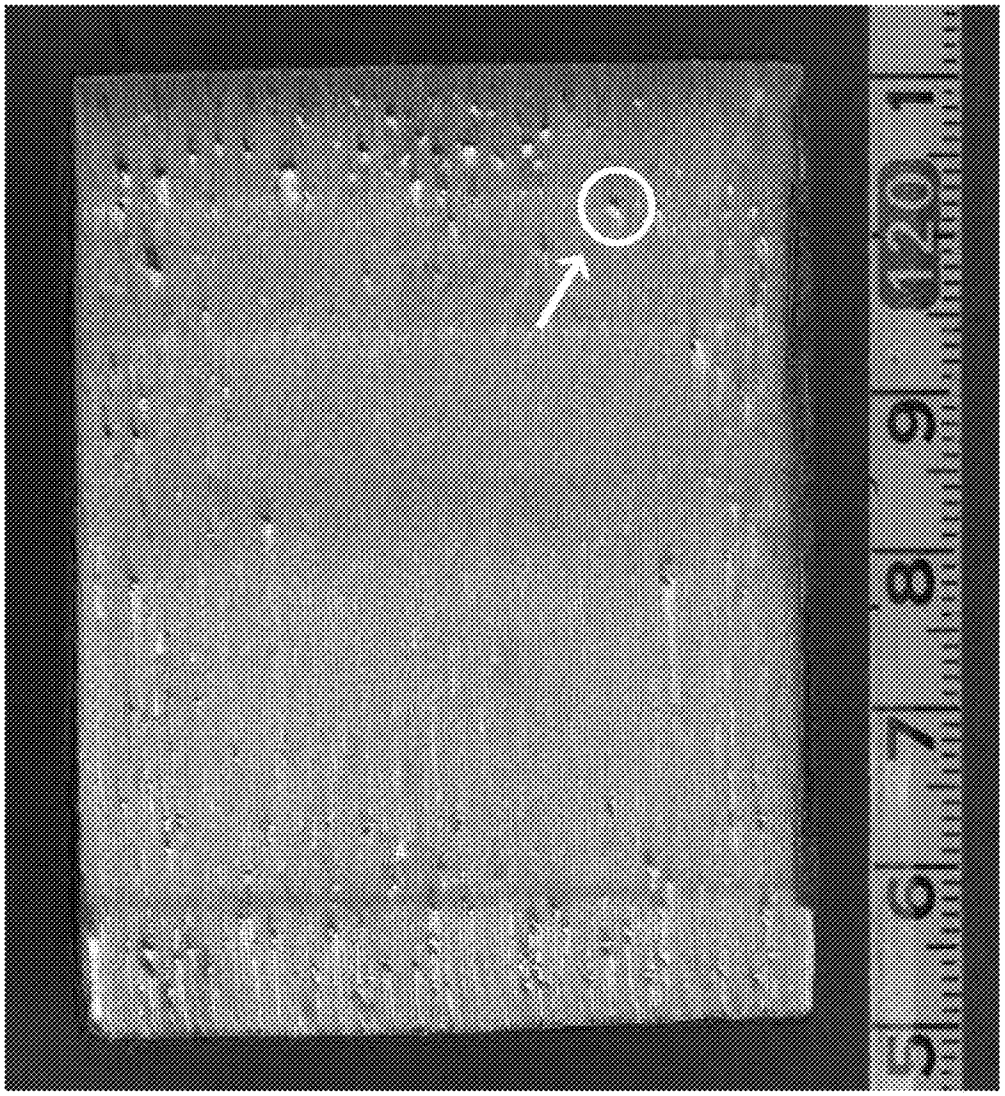
FIG. 2 is a photograph of a cross-section of a steel material including an SA defect portion.

Each of these steel species was cast into a 150 kg-ingot, and the ingot was subjected to homogenization heat treatment at 1,240° C. for 24 hours and then hot-worked to produce a square bar having a thickness of 80 mm, a width of 85 mm and a length of 2,200 mm. The square bar cooled to near room temperature was subjected to SA of heating to Ac3 temperature+25° C. and cooling to 620° C. at 15° C./H. Furthermore, since it was predicted that an SA defect as shown in FIG. 1 occurred depending on the compositions, annealing by holding for 8 hours at 680° C. that is less than the Ac1 temperature was added after SA so as to soften the specimen to a hardness allowing for machining.

It was confirmed using the square bar above that "a high impact value is achieved even in the case where the cooling rate after heating simulating hot working is small", and thereafter, (1) SA property, (2) machinability, (3) quenchability (impact value in the case where the quenching rate is small), (4) heat checking resistance, and (5) softening resistance were examined using the same square bar.

TABLE 1

| | | Chemical Composition (mass %) (balance: Fe) | | | | | | | | | |
|---|---|---|---|---|---|---|---|---|---|---|---|
| | | C | Si | V | Mn | Cr | Mn + Cr | Mn/Cr | Cu | Ni | Cu + Ni |
| Examples | 01 | 0.371 | 0.08 | 0.63 | 0.75 | 5.77 | 6.52 | 0.130 | 0.04 | 0.08 | 0.12 |
| | 02 | 0.398 | 0.15 | 0.47 | 0.65 | 5.66 | 6.31 | 0.115 | 0.05 | 0.09 | 0.14 |
| | 03 | 0.348 | 0.04 | 0.57 | 0.65 | 5.86 | 6.51 | 0.111 | 0.05 | 0.10 | 0.15 |
| | 04 | 0.385 | 0.12 | 0.52 | 0.85 | 5.86 | 6.71 | 0.145 | 0.06 | 0.06 | 0.12 |
| | 05 | 0.321 | 0.01 | 0.68 | 0.85 | 5.66 | 6.51 | 0.150 | 0.03 | 0.04 | 0.07 |
| | 06 | 0.370 | 0.09 | 0.62 | 0.75 | 5.77 | 6.52 | 0.130 | 0.03 | 0.07 | 0.10 |
| | 07 | 0.336 | 0.19 | 0.49 | 0.75 | 5.71 | 6.46 | 0.131 | 0.07 | 0.21 | 0.28 |
| | 08 | 0.377 | 0.004 | 0.55 | 0.70 | 5.81 | 6.51 | 0.120 | 0.08 | 0.12 | 0.20 |
| | 09 | 0.405 | 0.35 | 0.58 | 0.61 | 5.95 | 6.56 | 0.103 | 0.12 | 0.17 | 0.29 |
| | 10 | 0.315 | 0.31 | 0.65 | 0.64 | 5.61 | 6.25 | 0.114 | 0.15 | 0.15 | 0.30 |
| | 11 | 0.366 | 0.23 | 0.61 | 0.82 | 5.77 | 6.59 | 0.142 | 0.17 | 0.22 | 0.39 |
| | 12 | 0.357 | 0.27 | 0.60 | 0.55 | 5.95 | 6.50 | 0.092 | 0.23 | 0.09 | 0.32 |
| | 13 | 0.390 | 0.11 | 0.59 | 0.45 | 5.90 | 6.35 | 0.076 | 0.09 | 0.10 | 0.19 |
| | 14 | 0.369 | 0.09 | 0.63 | 0.75 | 5.77 | 6.52 | 0.130 | 0.04 | 0.05 | 0.09 |
| | 15 | 0.330 | 0.09 | 0.48 | 0.77 | 5.82 | 6.59 | 0.132 | 0.03 | 0.04 | 0.07 |
| | 16 | 0.325 | 0.10 | 0.50 | 0.80 | 5.88 | 6.68 | 0.136 | 0.20 | 0.03 | 0.23 |
| | 17 | 0.351 | 0.02 | 0.53 | 0.89 | 5.89 | 6.78 | 0.151 | 0.01 | 0.25 | 0.26 |
| | 18 | 0.362 | 0.03 | 0.64 | 0.62 | 5.89 | 6.51 | 0.105 | 0.02 | 0.05 | 0.07 |
| | 19 | 0.381 | 0.25 | 0.66 | 0.79 | 5.61 | 6.40 | 0.141 | 0.02 | 0.02 | 0.04 |
| | 20 | 0.373 | 0.15 | 0.67 | 0.84 | 5.61 | 6.45 | 0.150 | 0.04 | 0.06 | 0.10 |
| Comparative Example | 01 | 0.391 | 1.02 | 0.91 | 0.42 | 5.13 | 5.55 | 0.082 | 0.06 | 0.09 | 0.15 |
| | 02 | 0.359 | 0.48 | 0.62 | 0.69 | 5.51 | 6.20 | 0.125 | 0.03 | 0.05 | 0.08 |
| | 03 | 0.362 | 0.49 | 0.60 | 0.71 | 5.50 | 6.21 | 0.129 | 0.48 | 0.64 | 1.12 |
| | 04 | 0.351 | 0.08 | 0.89 | 0.61 | 5.52 | 6.13 | 0.111 | 0.04 | 0.04 | 0.08 |
| | 05 | 0.343 | 0.01 | 0.53 | 1.11 | 5.53 | 6.64 | 0.201 | 0.05 | 0.06 | 0.11 |
| | 06 | 0.372 | 0.19 | 0.77 | 0.56 | 5.32 | 5.88 | 0.105 | 0.06 | 0.56 | 0.62 |
| | 07 | 0.340 | 0.39 | 0.61 | 0.60 | 5.04 | 5.64 | 0.119 | 0.11 | 0.63 | 0.74 |
| | 08 | 0.407 | 0.15 | 0.69 | 0.62 | 6.47 | 7.09 | 0.096 | 0.04 | 0.06 | 0.10 |
| | 09 | 0.402 | 0.14 | 0.70 | 0.92 | 5.99 | 6.91 | 0.154 | 0.03 | 0.04 | 0.07 |

| | | Chemical Composition (mass %) (balance: Fe) | | | | | | |
|---|---|---|---|---|---|---|---|---|
| | | P | S | P + 5S | Mo | Al | N | Selective Addition |
| Examples | 01 | 0.017 | 0.0020 | 0.027 | 2.32 | 0.017 | 0.021 | |
| | 02 | 0.015 | 0.0030 | 0.030 | 2.33 | 0.014 | 0.019 | |
| | 03 | 0.015 | 0.0020 | 0.025 | 2.36 | 0.015 | 0.018 | |
| | 04 | 0.004 | 0.0004 | 0.006 | 2.34 | 0.018 | 0.020 | |
| | 05 | 0.013 | 0.0019 | 0.023 | 2.37 | 0.020 | 0.020 | |
| | 06 | 0.003 | 0.0025 | 0.016 | 2.07 | 0.023 | 0.023 | |
| | 07 | 0.019 | 0.0008 | 0.023 | 2.05 | 0.010 | 0.003 | |
| | 08 | 0.024 | 0.0013 | 0.031 | 2.16 | 0.007 | 0.013 | |
| | 09 | 0.029 | 0.0003 | 0.031 | 2.39 | 0.034 | 0.005 | |
| | 10 | 0.008 | 0.0035 | 0.026 | 2.08 | 0.028 | 0.045 | |
| | 11 | 0.017 | 0.0030 | 0.032 | 2.24 | 0.031 | 0.040 | |
| | 12 | 0.014 | 0.0029 | 0.029 | 2.20 | 0.003 | 0.009 | |
| | 13 | 0.011 | 0.0038 | 0.030 | 2.28 | 0.040 | 0.031 | |
| | 14 | 0.013 | 0.0018 | 0.022 | 2.33 | 0.,019 | 0.007 | 0.023Ti, 0.0012B |
| | 15 | 0.017 | 0.0019 | 0.027 | 2.07 | 0.021 | 0.004 | 0.03Nb |
| | 16 | 0.002 | 0.0024 | 0.014 | 2.12 | 0.008 | 0.006 | 0.06Ti |
| | 17 | 0.002 | 0.0011 | 0.008 | 2.31 | 0.003 | 0.010 | 1.87W |
| | 18 | 0.012 | 0.0016 | 0.020 | 2.35 | 0.012 | 0.015 | 0.96Co |
| | 19 | 0.009 | 0.0010 | 0.014 | 2.38 | 0.006 | 0.035 | 0.0023Ca |
| | 20 | 0.006 | 0.0016 | 0.014 | 2.32 | 0.002 | 0.027 | 0.28Bi |
| Comparative Example | 01 | 0.032 | 0.0067 | 0.066 | 1.22 | 0.023 | 0.009 | |
| | 02 | 0.014 | 0.0019 | 0.024 | 1.25 | 0.021 | 0.019 | |
| | 03 | 0.015 | 0.0020 | 0.025 | 1.24 | 0.021 | 0.019 | |
| | 04 | 0.014 | 0.0021 | 0.025 | 2.97 | 0.016 | 0.011 | |
| | 05 | 0.001 | 0.0002 | 0.002 | 2.48 | 0.020 | 0.016 | |
| | 06 | 0.009 | 0.0006 | 0.012 | 2.19 | 0.004 | 0.021 | |
| | 07 | 0.008 | 0.0039 | 0.028 | 2.97 | 0.009 | 0.017 | |
| | 08 | 0.014 | 0.0018 | 0.023 | 1.69 | 0.021 | 0.022 | |
| | 09 | 0.014 | 0.0017 | 0.023 | 2.35 | 0.063 | 0.019 | |

<Examination of Impact Value in the Case Where Cooling Rate After Heating Simulating Hot Working is Small>

Figure 23:
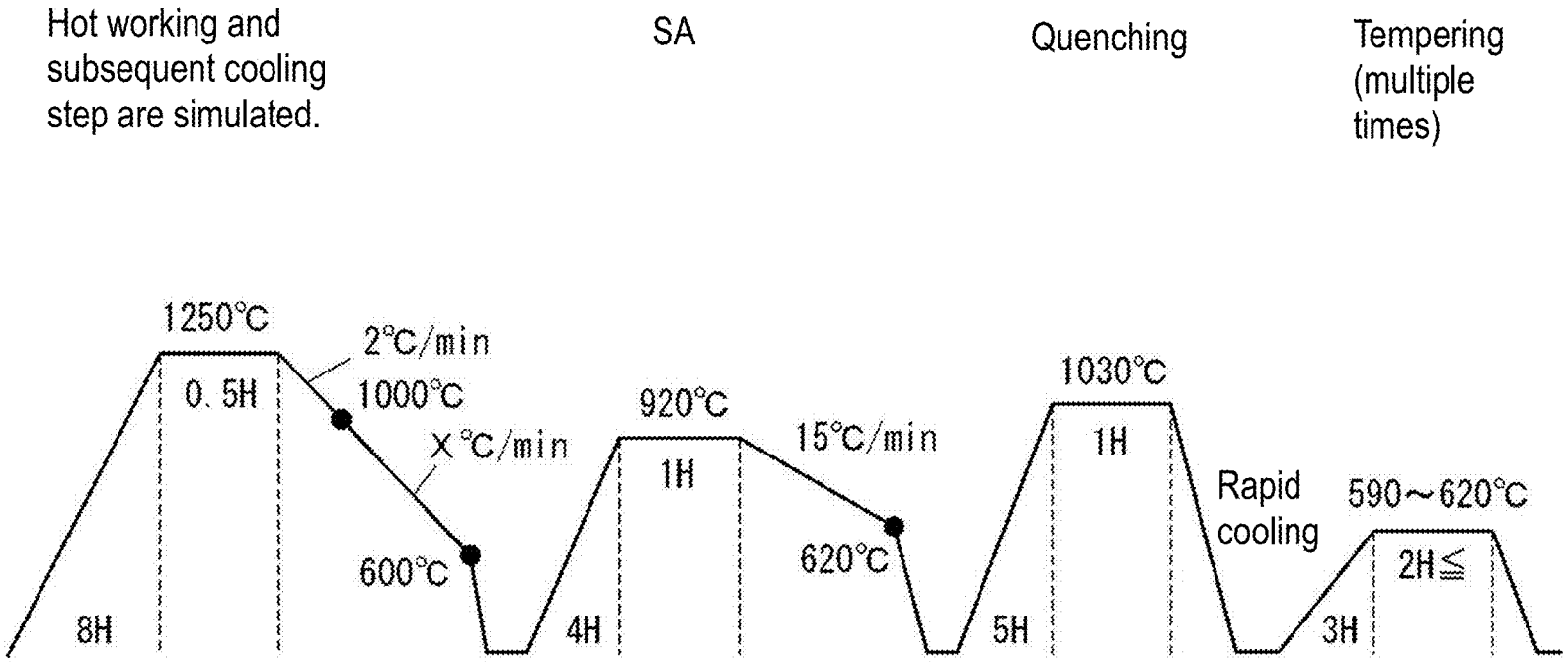
FIG. 23 is a diagram illustrating a heat treatment process at the time of producing a specimen for the evaluation of impact value.

Ten materials of 12 mm×12 mm×55 mm were prepared from the annealed square bar above having a thickness of 80 mm, a width of 85 mm and a length of 2,200 mm and thermally refined to a hardness of 45.5 HRC to 46.5 HRC by the process illustrated in FIG. 23, and thereafter, specimens were prepared from the bar materials and evaluated for the impact value. The specimen shape and evaluation method are the same as in the contents described hereinbefore. The process before SA assumes the manufacture of a block material for molds, and the process after quenching assumes thermal refining of a mold manufactured from the block material. The experiment of FIG. 23 has the same idea as FIG. 4 but differs in two points.

The first difference is the cooling rate to 1,000° C. from 1,250° C. Since the cooling rate in the temperature range of more than 1,000° C. does not greatly affect the impact value as described above, in FIG. 23, the specimen was cooled to 1,000° C. from 1,250° at 2° C./min, and the subsequent cooling rate X to 600° C. was controlled.

The second difference is the omission of normalizing before SA.

The cooling rate X was set at three levels of 1° C./min, 2° C./min, and 30° C./min X assumes the cooling rate in the central part of a block material, which is cooled after industrial hot working. The cooling rate is X≤1.5° C./min in the case where a large block material having a thickness of 200 mm or more is slowly cooled so as to avoid cracking, the cooling rate is 2° C./min≤X in the case where a large block material having a thickness of 200 mm or more is rapidly cooled while avoiding cracking, and the cooling rate is 30° C./min≤X in the case where a small block material is cooled by a method where the cooling strength is very strong, such as water cooling. In this verification assuming a large block material, a high impact value close to that at X=30° C./min of a small block material must necessarily be obtained even at X=2° C./min, and at the same time, the impact value at a general cooling rate X=1° C./min is also confirmed.

The results are shown in Table 2. The grade is "S" for 30 J/cm$^2$ impact value, is "A" for 25 J/cm$^2$≤impact value<30 J/cm$^2$, is "B" for 20 J/cm$^2$≤impact value<25 J/cm$^2$, and is "C" for impact value<20 J/cm$^2$. The C grade is a very bad level failing to satisfy 20 J/cm$^2$ or more necessary for a die casting mold. The A and S grades are levels satisfying 25 J/cm$^2$ or more ideally required for a die casting mold.

In the case where the S and A grades are received at X≤2° C./min, the specimens can be judged as a steel material encouraging meaningful discussion about the later-described quenchability. The verification this time is performed under the conditions where the quenchability does not become a problem (a small specimen is quenched at a large cooling rate). Specifically, "rapid cooling" of 1,030° C. quenching in FIG. 23 means that the cooling rate to 250° C. from 450° C., which greatly affects the impact value, is as large as 30° C./min (in the case of a large die casting mold that is hard to cool, from 1.2° C./min to 10° C./min). Therefore, unless a high impact value is obtained in the verification at rapid cooling, no matter how large the value of Mn+Cr is, the impact value of a large mold (the quenching rate is small) manufactured from a large block material does not increase, and it is meaningless to discuss the quenchability.

in other Examples. However, since an S grade is received at X=2° C./min, when applied to the industrial process, it may be said that high impact value can be achieved stably if the block material after hot working is cooled at 2° C./min or more while avoiding cracking.

The reason why Example 19 received an A grade is because the mode of inclusions is changed due to Ca added so as to enhance the machinability. Even so, an A grade is stably given regardless of X. In other Examples, a high impact value is exhibited even at X=1° C./min. When applied to the industrial process, it may be said that a high impact value is obtained by subjecting the block material after hot working to cracking-avoiding slow cooling. That is, in the case where a cooling method having high cooling strength is applied, a high impact value is obtained even by conventional slow cooling without incurring the risk of causing cracking or excessive thermal deformation. In addition, even with the same S grade, the impact value was higher as X was larger. Accordingly, when a method of cooling the block material after hot working at 2° C./min or more while avoiding cracking is established, the effect of low Si content and low V content on achieving high impact value stably can be further enhanced.

With respect to Comparative Examples, Comparative Example 05 and Comparative Example 08 have an S or A grade, similarly to Examples. Because, these steel species have also low Si amount and low V amount, and in Comparative Example 08, since the amounts of C and V are large, the amount of carbides precipitated at grain boundaries at slow cooling of X=1° C./min is larger than that in other Examples. On the other hand, even with low Si amount and low V amount, the impact value is low in Comparative Example 09 where the Al amount is large. The reason for this is that since the oxygen content is high, coarse alumina and a cluster thereof are increased, and formation or propagation of cracks is accelerated. In other Comparative Examples, since either the Si or V amount is large, the impact value is low particularly at X=1° C./min. In Comparative Example 07, since the Mo amount is excessively large, the impact value is low. In some steels, the B or C grade is received at X=2° C./min and it is understood that even if a method of cooling the block material after hot working at 2° C./min or more while avoiding cracking is

TABLE 2

| | Example | | | | | | | | | | | | | | | | | | | |
|---|---|---|---|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 | 17 | 18 | 19 | 20 |
| X = 1° C./min | S | S | S | S | S | S | S | S | A | S | S | S | S | S | S | S | S | S | A | S |
| X = 2° C./min | S | S | S | S | S | S | S | S | S | S | S | S | S | S | S | S | S | S | A | S |
| X = 30° C./min | S | S | S | S | S | S | S | S | S | S | S | S | S | S | S | S | S | S | A | S |

| | Comparative Example | | | | | | | | |
|---|---|---|---|---|---|---|---|---|---|
| | 01 | 02 | 03 | 04 | 05 | 06 | 07 | 08 | 09 |
| X = 1° C./min | C | B | B | C | S | C | B | A | C |
| X = 2° C./min | C | A | A | B | S | B | A | S | C |
| X = 30° C./min | S | S | S | S | S | S | A | S | B |

As shown in Table 2, in Examples, the grade is S or A at all X, and the effect due to low Si and low V is obtained as intended. The reason why an A grade is given at X=1° C./min in Example 09 is because the amounts of C and Si are large and in turn, the amount of carbides precipitated at grain boundaries at slow cooling of X=1° C./min is larger than that established, a high impact value is not obtained. When applied to the industrial process, it can be said that in Comparative Examples except for Comparative Example 05 and Comparative Example 08, a high impact value is obtained in a small block material but a high impact value is not obtained in a large block material.

Incidentally, specimens of which impact value had been examined were subjected to polishing and corrosion after the impact test and observed or analyzed by an optical microscope, an electron microscope or EPMA, etc., and the carbides precipitated at austenite grain boundaries were thereby examined at the same time.

Figure 27A:
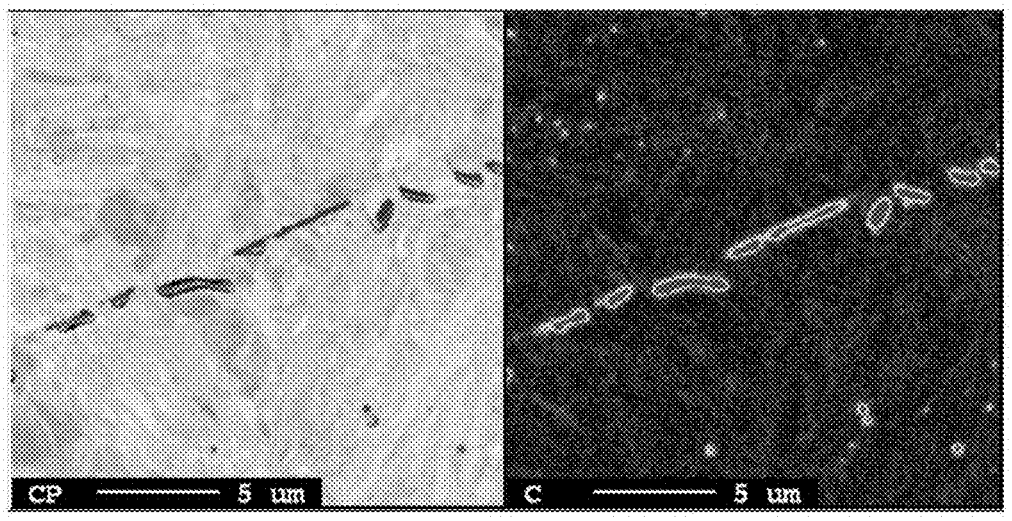
FIG. 27A is a photograph showing the mode of carbides in Comparative Example 01.
Figure 27B:
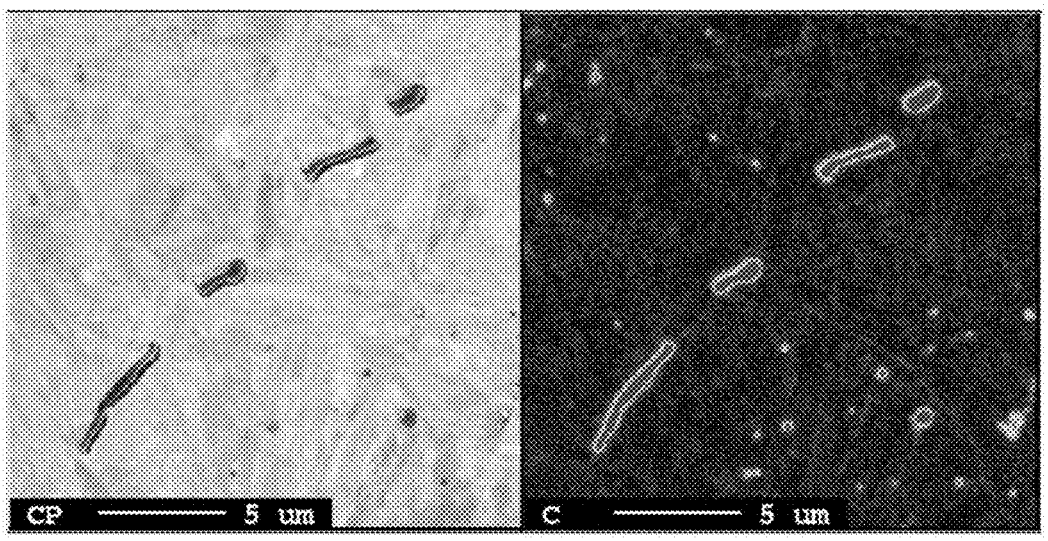
FIG. 27B is another photograph showing the mode of carbides in Comparative Example 01.
Figure 27C:
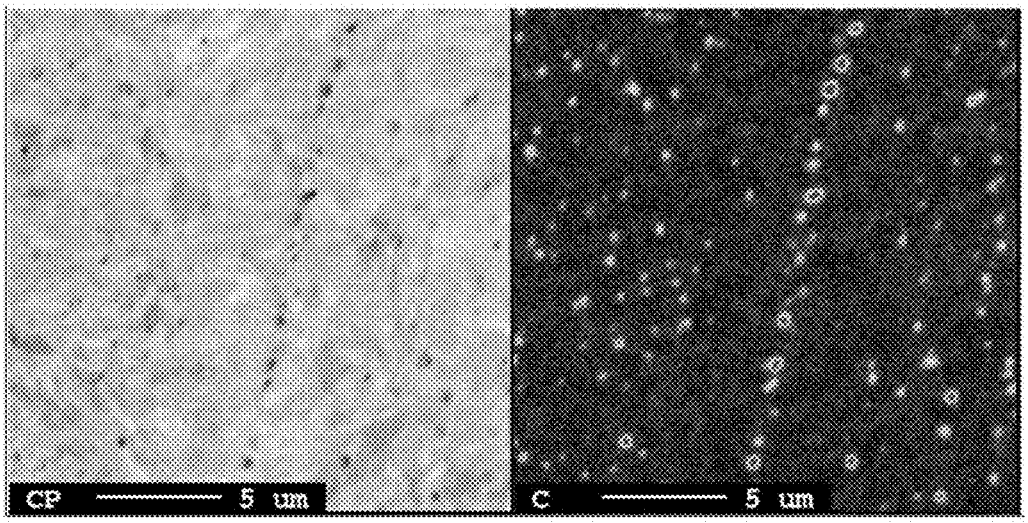
FIG. 27C is a photograph showing the mode of carbides in Example 01.

FIGS. 27A to 27C show the carbides (including carbonitrides) observed. FIG. 27A is a specimen in which the impact value was 13 J/cm$^2$ at "X=1° C./min of Comparative Example 01". In FIGS. 27A to 27C, the left figure shows a state of analytical field of view, and the right figure shows a state of shades (actually, color) being added according to the C concentration. FIG. 27A is an inferior microstructure that the present invention intends to avoid, and a string of large carbides of 0.6 μm or more is observed.

FIG. 27B is a specimen in which the impact value was 17 J/cm$^2$ at "X=2° C./min of Comparative Example 01". Since Comparative Example 01 is a steel species having large Si and V amounts, even in the case where the cooling rate X is increased, a string of carbides of 0.6 μm or more is not eliminated.

On the other hand, FIG. 27C is a specimen in which the impact value was 45 J/cm$^2$ at "X=2° C./min of Comparative Example 01". Although a string of carbides is observed and is unclear, the carbide size is less than 0.6 μm.

As a result of examination, in specimens where the judgment result of the impact value of Table 2 is "S" or "A", when carbides having a maximum length of more than 0.3 μm are observed, the maximum length of carbides forming a dashed-line-form discontinuous string at intervals of 50 μm or less was more than 0.3 μm and less than 0.6 μm, or the region where carbides having a maximum length of 0.6 μm or more form a dashed-line-form discontinuous string at intervals of 50 μm or less was less than 300 μm. On the other hand, with respect to specimens where the judgment result is except for "S" or "A", a region where the carbides above form a dashed-line-form discontinuous string over 300 μm or more is observed.

These results indicate that even in the case where the cooling rate after 1,250° C. heating simulating hot working is 2° C./min or less, specimens of Examples have a high impact value. Then, in the following, (1) SA property, (2) machinability, (3) quenchability (impact value in the case where the quenching rate is small), (4) heat checking resistance, and (5) softening resistance are evaluated.

<Evaluation of SA Property>

Figure 24:
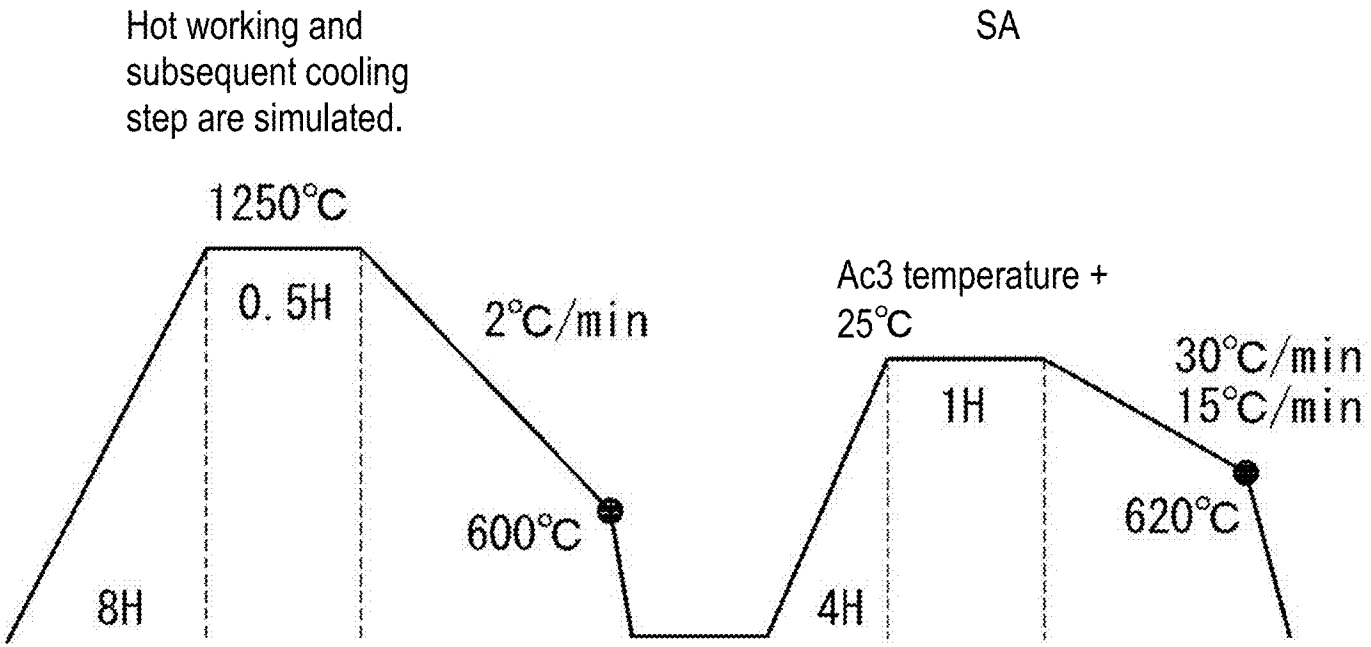
FIG. 24 is a diagram illustrating a heat treatment process at the time of producing a specimen for the evaluation of SA property.

A specimen of 12 mm×12 mm×20 mm prepared from the annealed square bar above having a thickness of 80 mm, a width of 85 mm and a length of 2,200 mm was subjected to a vacuum heat treatment of FIG. 24 and evaluated for the SA property. The experiment of FIG. 24 has the same idea as FIG. 15 (e.g., the grasping in advance of Ac3 temperature, the way of thinking about omission of normalizing before SA), and as the cooling rate of SA, two levels of 15° C./H and 30° C./H were set. Industrially, it is desired to set the cooling rate of SA high so as to shorten the processing time. Then, the effect of the cooling rate of SA was also verified.

The cut surface of the specimen after SA was first observed with eyes, and the specimen was then polished and measured for the hardness. Furthermore, after corroding the specimen, the microstructure was observed with a microscope, and the SA property was evaluated in terms of microstructure and hardness.

The results are shown in Table 3. The grade is "S" for a soft state where the entire surface of the specimen is free of a hard portion as seen in FIG. 1 and the HRB hardness is 100 or less. The "C" grade is a case where a hard portion (bainite or martensite) as seen in FIG. 1 exists and since indenting in the hardness measurement may be applied to the region including bainite or martensite, a measurement point where the HRB hardness exceeds 100 may be generated. The C grade is an SA defect as in FIG. 1, and industrially, this must be absolutely avoided. After SA, either an appropriate microstructure or a defective microstructure is determined, and therefore, the grade also has two choices, either S or C.

TABLE 3

| | Example | | | | | | | | | | | | | | | | | | | |
|---|---|---|---|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 | 17 | 18 | 19 | 20 |
| 30° C./H | S | S | S | S | S | S | S | S | S | S | S | S | S | S | S | S | S | S | S | S |
| 15° C./H | S | S | S | S | S | S | S | S | S | S | S | S | S | S | S | S | S | S | S | S |

| | Comparative Example | | | | | | | | |
|---|---|---|---|---|---|---|---|---|---|
| | 01 | 02 | 03 | 04 | 05 | 06 | 07 | 08 | 09 |
| 30° C./H | S | S | C | S | C | S | C | S | C |
| 15° C./H | S | S | C | S | C | S | S | S | S |

In Examples where Mn/Cr≤0.155 and Cu+Ni≤0.84, an S grade was given at both cooling rates. Specimens of Examples were confirmed to have excellent SA property. Steel having small Mn/Cr can be expected to be softened to 100 HRB or less even in the case where the cooling rate of SA is further increased over 30° C./H so as to shorten the process time.

With respect to Comparative Examples, an S grade is given regardless of the cooling rate as well as Examples are Comparative Example 01, Comparative Example 02, Comparative Example 04, Comparative Example 06 and Comparative Example 08. Each of these steel species has Mn/Cr≤0.125. In Comparative Example 03, Mn/Cr is as small as 0.129 but since Cu+Ni is as large as 1.12, the C grade is given at both cooling rates. On the other hand, as for two steel species of Comparative Example 07 where the steel has Ni+Cu=0.74 and Comparative Example 09 where the steel has Mn/Cr=0.154, although the S grade is received at 15° C./H, i.e., a general cooling rate, the C grade is given at 30° C./H, and it is understood that these cannot respond to needs for increasing of the cooling rate of SA so as to shorten the process time. However, as long as a general cooling rate 15° C./H is satisfied, an SA defect as in FIG. 1 does not occur.

When applied to the industrial SA process, these results are as follows. The process corresponds to the conditions where a large block material produced from a large ingot of 1,000 kg or more is heated and held in a furnace at an appropriate temperature exceeding Ac3 temperature and then cooled at a rate of 30° C./H or less and when reached 620° C., the block material is removed from the furnace. In such an SA process simulating actual production, specimens of Examples were softened to 100 HRB or less. Accordingly, steels of Examples are determined to exhibit good SA property also in actual production of a block material for large molds.

<Evaluation of Machinability>

A material of 50 mm×55 mm×200 mm was prepared from the annealed square bar above having a thickness of 80 mm, a width of 85 mm and a length of 2,200 mm. The end mill machinability of the material was determined by the amount of wear of the cutting tool at a point when reaching a cutting distance of 30 m at a cutting rate of 400 m/min. The results are shown in Table 4.

The grade is "S" for amount of wear 0.15 mm, is "A" for 0.15 mm<amount of wear≤0.30 mm, is "B" for 0.30 mm<amount of wear≤0.50 mm, and is "C" for 0.50 mm<amount of wear. The C grade is a very bad level not satisfying the machinability necessary for machining of a die casting mold, where the amount of wear is large and at the same time, chipping of the cutting tool often occurs. The B grade is also not good, but the material has machinability enough to withstand practical use and machining of a die casting mold is industrially possible (however, the work efficiency needs to be reduced). The A and S grades are a state having good machinability, and in particular, the S grade is a very preferable state hardly causing a trouble or problem during machining When applied to the industrial SA process, these results are as follows. The process corresponds to a process where a large block material produced from a large ingot of 1,000 kg or more is softened by annealing and then roughly worked into a die casting mold by machining. In such a process simulating actual production, specimens of Examples exhibited machinability enough to withstand practical use. Accordingly, it is determined that also in the working of a mold by machining from a large block material, the wear of a cutting tool used for working the steel material of Examples is not significantly accelerated and machining of steels of Examples is industrially established.

<Evaluation of Quenchability (Impact Value in the Case where the Quenching Rate is Small)>

Figure 25:
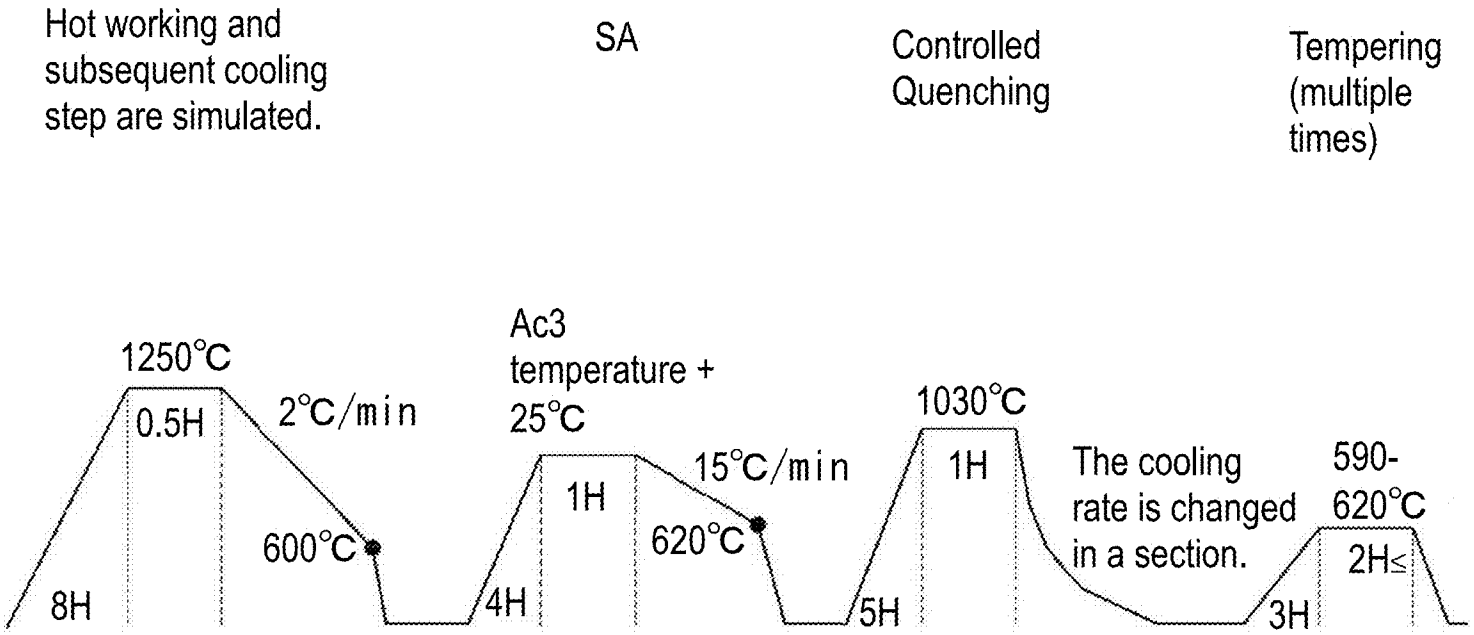
FIG. 25 is a diagram illustrating a heat treatment process at the time of producing a specimen for the evaluation of quenchability.
Figure 26A:
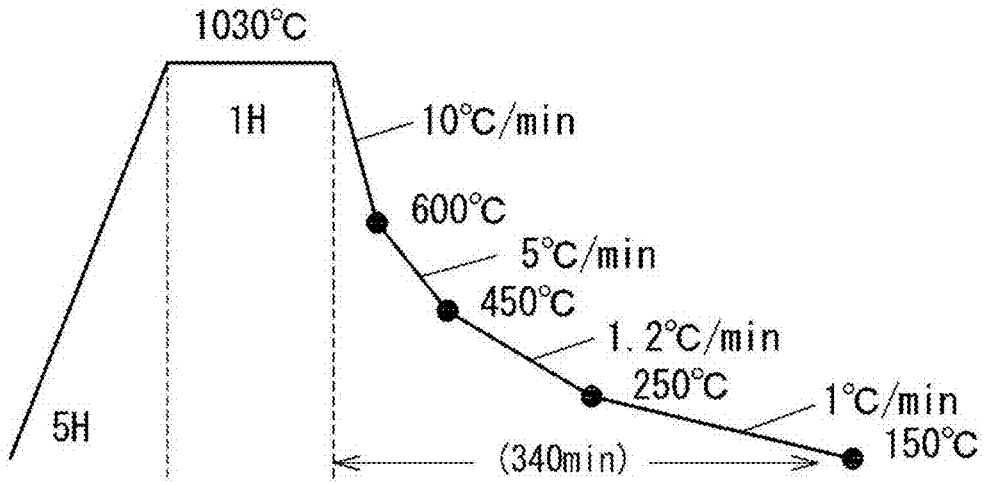
FIG. 26A is a diagram illustrating details of the controlled quenching (slow cooling) of FIG. 25.
Figure 26B:
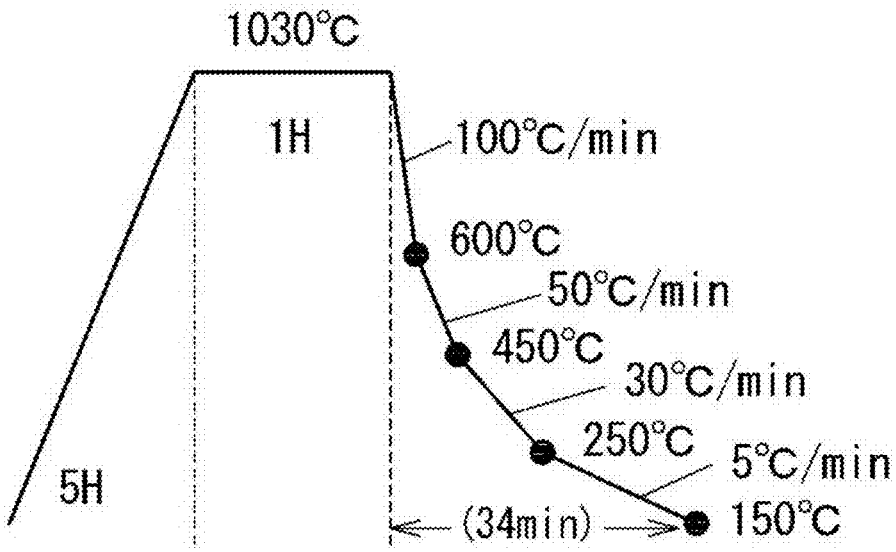
FIG. 26B is a diagram illustrating details of the controlled quenching (rapid cooling) of FIG. 25.

Ten materials of 12 mm×12 mm×55 mm were prepared from the annealed square bar above having a thickness of 80 mm, a width of 85 mm and a length of 2,200 mm and thermally refined to a hardness of 45.5 HRC to 46.5 HRC by performing a vacuum heat treatment of FIGS. 25, 26A and 26B. The process before SA assumes the manufacture of a block material for molds, and the process after quenching assumes thermal refining of a mold manufactured from the block material. The cooling rate of 2° C./min to 600° C. after 1,250° C. heating corresponds to a cooling rate in the case where a large block material with a thickness of 200 mm or more is rapidly cooled under the conditions not causing cracking or excessive thermal deformation.

The experiments of FIGS. 25, 26A and 26B have the same idea as FIG. 17 and FIG. 18 (e.g., the effect of cooling rate to 1,000° C. from 1,250° C. on the grain boundary precipitation of carbides, the way of thinking about omission of normalizing before SA) but differ in one point. The difference is to evaluate also the rapidly cooled material as shown in FIG. 26B. Rapid cooling means that the cooling rate to 250° C. from 450° C., which greatly affects the impact value, is as large as 30° C./min and ideal. In the case of a large die casting mold that is hard to cool, the cooling rate to 250° C. from 450° C. is from 1.2° C./min to 10° C./min, and this is depicted in FIG. 26A as the worst condition in the simulation.

TABLE 4

| | Example | | | | | | | | | | | | | | | | | | | |
|---|---|---|---|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 | 17 | 18 | 19 | 20 |
| 400 m/min, distance 30 m | B | B | B | B | B | B | B | B | B | B | B | B | B | B | B | B | B | B | A | A |

| | Comparative Example | | | | | | | | |
|---|---|---|---|---|---|---|---|---|---|
| | 01 | 02 | 03 | 04 | 05 | 06 | 07 | 08 | 09 |
| 400 m/min, distance 30 m | S | A | A | B | C | B | A | B | B |

In Examples except for Example 19 and Example 20, the B grade is given. Example 08 of 0.004Si had a possibility of receiving the C grade, but the machinability of the B grade was ensured by setting P+5S=0.031. In Example 05 where the Si amount is increased up to 0.01, although P+5S is 0.023 and lower than that in Example 08, the B grade is given. In Example 19 and Example 20 where a free-cutting element is added, the A grade is given. Examples are a low-Si type and therefore, the machinability is not good, but these could be confirmed to have machinability enough to withstand practical use.

As for Comparative Examples, Comparative Example 05 where the steel has 0.01Si and P+5S=0.002 is received the C grade. Both Si and P+5S are low, and therefore, the machinability is poor. Comparative Example 02, Comparative Example 03 and Comparative Example 07, where Si is approximately from 0.4 to 0.5, have the A grade. Furthermore, Comparative Example 01 (SKD61) where the Si amount is large has the S grade, and this is consistent with the industrial evaluation that the machinability of SKD61 is very good. In other Comparative Examples, the Si amount is equivalent to that in Examples and therefore, the grade is the same B as Examples.

Specimens were prepared from materials being subjected to thermally refining to a hardness of 45.5 HRC to 46.5 HRC in the process of FIGS. 25, 26A and 26B and evaluated for the impact value. The results are shown in Table 5. The grade is "S" for 30 J/cm$^2$ impact value, is "A" for 25 J/cm$^2$≤impact value<30 J/cm$^2$, is "B" for 20 J/cm$^2$≤impact value<25 J/cm$^2$, and is "C" for impact value<20 J/cm$^2$. The C grade is a very bad level failing to satisfy the impact value of 20 J/cm$^2$ necessary for a die casting mold. The A and S grades are levels satisfying the impact value of 25 J/cm$^2$ or more ideally required for a die casting mold. In the case where a slowly cooled material has an impact value equivalent to that of a rapidly cooled material, the steel can be said to have high quenchability.

TABLE 5

| | Example | | | | | | | | | | | | | | |
|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 |
| 1.2° C./min | S | S | S | S | S | S | S | S | A | S | S | S | S | S | S |
| 30° C./min | S | S | S | S | S | S | S | S | A | S | S | S | S | S | S |

| | Example | | | | | Comparative Example | | | | | | | | |
|---|---|---|---|---|---|---|---|---|---|---|---|---|---|---|
| | 16 | 17 | 18 | 19 | 20 | 01 | 02 | 03 | 04 | 05 | 06 | 07 | 08 | 09 |
| 1.2° C./min | S | S | S | A | S | C | C | C | C | S | C | B | A | C |
| 30° C./min | S | S | S | A | S | C | B | B | C | S | B | B | A | C |

In all Examples, the slowly cooled material (1.2° C./min) has the same S or A grade as the rapidly cooled material (30° C./min), and it is understood that the quenchability is high. The A grade is given only to two steel species of Example 09 and Example 19, and others have the S grade. In Example 09 where the C and Si amounts are large, the amount of carbides precipitated at grain boundaries during cooling at 2° C./min after 1,250° C. heating simulating hot working is larger than in other Examples, and the impact value is slightly reduced, resulting in the A grade. In Example 19 where the Si and V amounts are small and Mn+Cr is as large as 6.40, the mode of inclusions is changed due to Ca added for enhancing the machinability, and this change adversely affects the impact value, as a result, the A grade is given.

Among Comparative Examples, Comparative Examples where the grade is S or A as well as Examples are Comparative Example 05 and Comparative Example 08. Because, in these steel species, the Si and V amounts are low, similarly to Examples, and the amount of carbides precipitated at grain boundaries during cooling at 2° C./min after 1,250° C. heating simulating hot working is small as well as Mn+Cr is as large as 6.60 or more. On the other hand, in Comparative Example 09 where the Si and V amounts are equal to those in Comparative Example 08, since the Al amount is large, coarse alumina or a cluster thereof increases, accelerating the formation or propagation of cracks, and therefore, the impact value is low. It is understood that even in the case where the Si and V amounts are reduced and Mn+Cr is increased, if the types and amounts of other elements are not appropriate, the impact value of a slowly cooled material cannot be made high. In Comparative Example 01 that is SKD61, not only the Si and V amounts are large but also Mn+Cr is small, and therefore, the impact value is very low due to two problems of precipitation of carbides at grain boundaries and quenchability. This result is also consistent with FIG. 5. When applied to the industrial process, the test process above is as follows. The process corresponds to a case where the cooling rate to 600° C. from 1,000° C. in the central part of a block material is ser to 2° C./min or more when cooling a large block material produced by hot working from a large ingot of 1,000 kg or more, and the block material is softened by annealing, then machined to manufacture a large die casting mold, furthermore, quenched by setting the cooling rate to 250° C. from 450° C. at 1.2° C./min or more and thermally refined to 46 HRC. In such a process simulating actual production, specimens of Examples exhibited a high impact value of 25 J/cm$^2$ or more. Accordingly, it is determined that a high impact value is obtained also in an actual large die casting mold composed of the steel materials of Examples.

<Evaluation of Heat Checking Resistance>

Two materials having a diameter of 73 mm×51 mm were prepared from the annealed square bar above having a thickness of 80 mm, a width of 85 mm and a length of 2,200 mm and thermally refined to a hardness of 45.5 HRC to 46.5 HRC by performing a vacuum heat treatment of FIGS. 25, 26A and 26B. Specimens (end face on one side is subjected to chamfering C5) having a diameter of 72 mm×50 mm were prepared from the materials and evaluated for the heat checking resistance. A thermal cycle where the end face on the chamfering side is heated at 575° C. to 585° C. by high frequency radiation, cooled to 40° C. to 100° C. by injection water, and at a point when returned to 120° C. to 180° C. by a thermal recuperation during cooling, again heated by high frequency radiation, was repeated 25,000 times. The reason why the achieving temperature has a range is because steel materials differ in thermal conductivity. In this thermal cycle test, generation of a difference in the achieving temperature due to thermal conductivity, in an actual die casting mold, is simulated. After 25,000 cycles, a heated and cooled surface of the specimen was cut out at 5 points (a central part of the surface and 4 points at intervals of 90° in the circumferential direction midway between center and end) and evaluated for the depth of cracks, and the heat checking resistance was determined by the maximum crack length.

The results are shown in Table 6. The grade is "S" for maximum crack length<1.5 mm, is "A" for 1.5 mm≤maximum crack length<2.5 mm, is "B" for 2.5 mm≤maximum crack length<3.5 mm, and is "C" for 3.5 mm<maximum crack length. The C grade is a very bad level having a high risk of leading to gross cracking if it is an actual die casting mold.

TABLE 6

| | Example | | | | | | | | | | | | | | |
|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 |
| 1.2° C./min | S | S | S | S | S | S | A | S | A | A | A | A | S | S | S |
| 30° C./min | S | S | S | S | S | S | A | S | A | A | A | A | S | S | S |

TABLE 6-continued

| | Example | | | | | Comparative Example | | | | | | | | |
|---|---|---|---|---|---|---|---|---|---|---|---|---|---|---|
| | 16 | 17 | 18 | 19 | 20 | 01 | 02 | 03 | 04 | 05 | 06 | 07 | 08 | 09 |
| 1.2° C./min | S | S | S | A | S | C | C | B | A | S | B | C | S | S |
| 30° C./min | S | S | S | A | S | C | B | B | S | S | A | B | S | S |

In all Examples, the grade is S or A and a preferable state with shallow cracks is provided. Even in the case where the controlled quenching rate is as small as 1.2° C./min, the same performance as that in rapid cooling of 30° C./min is exhibited, and it is understood that high quenchability contributes also to high heat checking resistance. In addition, Examples of Si≤0.15 have the S grade, and this reveals that Si has a great effect on the heat checking resistance.

Comparative Examples where the S grade is given are Comparative Example 05, Comparative Example 08 and Comparative Example 09. In these three steel species, as with Examples, the quenchability is high (Mn+Cr≤6.25) and S≤0.15. In the case of steel having poor quenchability, in the case where the controlled quenching rate is as small as 1.2° C./min, the heat checking resistance becomes worse than that in rapid cooling of 30° C./min.

<Evaluation of Softening Resistance>

Two materials of 12 mm×12 mm×20 mm were prepared from the annealed square bar above having a thickness of 80 mm, a width of 85 mm and a length of 2,200 mm and thermally refined to a hardness of 45.5 HRC to 46.5 HRC by performing a vacuum heat treatment of FIGS. 25, 26A and 26B. These materials were heated at 580° C. in vacuum, held for 24 hours, then cooled to room temperature, and measured for the hardness. As the reduction in the hardness after 580° C. heating is smaller, the softening resistance is higher, which is preferable.

The results are shown in Table 7. The grade is "S" for reduction in hardness<2.5 HRC, is "A" for 2.5 HRC≤reduction in hardness<3.2 HRC, is "B" for 3.2 HRC≤reduction in hardness<4.0 HRC, and is "C" for 4.0 HRC<reduction in hardness. The C grade is a very bad level where if it is an actual die casting mold, the surface is significantly softened and this becomes a factor that greatly deteriorates the heat checking resistance.

TABLE 7

| | Example | | | | | | | | | | | | | | |
|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 |
| 1.2° C./min | S | S | S | S | S | S | S | S | A | A | A | A | S | S | S |
| 30° C./min | S | S | S | S | S | S | S | S | A | A | A | A | S | S | S |

| | Example | | | | | Comparative Example | | | | | | | | |
|---|---|---|---|---|---|---|---|---|---|---|---|---|---|---|
| | 16 | 17 | 18 | 19 | 20 | 01 | 02 | 03 | 04 | 05 | 06 | 07 | 08 | 09 |
| 1.2° C./min | S | S | S | A | S | A | B | B | S | S | S | A | C | B |
| 30° C./min | S | S | S | A | S | B | B | B | S | S | S | B | C | B |

In all Examples, the grade is S or A, and a preferable state with a small reduction in hardness is provided. Even in the case where the controlled quenching rate is as small as 1.2° C./min, the same performance as in rapid cooling of 30° C./min is exhibited, and it is understood that high quenchability contributes additionally to high stabilization of the softening resistance. Out of Examples, in 5 steel species determined as the A grade, Si is 0.23 or more, and it is also understood that in the case where the Si amount is large, emission of C is accelerated to coarsen carbides and the hardness is likely to be reduced.

Comparative Examples where the S grade is given are Comparative Example 04, Comparative Example 05 and Comparative Example 06. In these three steel species, the Si amount is small, the Cr amount is small, and the Mo amount is large. Accordingly, carbides can hardly be coarsened, and the hardness is also less likely to be reduced. Comparative Example 08 where the Cr amount is large has the C grade, because coarsening of carbides is accelerated and therefore, the hardness of high Cr steel readily decreases. In Comparative Example 01 and Comparative Example 07, the softening resistance at a controlled quenching rate of 1.2° C./min is higher than that in the case of 30° C./min. The reason therefor is that due to poor quenchability, in the case where the quenching rate is small, the phase becomes bainite. Bainite has higher softening resistance than martensite.

<Summary of Properties>

The results of Tables 2 to 7 are shown together in Table 8. In Examples, "C" is not given to 5 important properties. On the other hand, in Comparative Examples, at least one "C" is given. In this way, Examples solved all of conventional problems and provide a very good balance among (1) SA property, (2) machinability, (3) quenchability, (4) heat checking resistance, and (5) softening resistance. In addition, even in the case where the cooling rate after hot working is small, a high impact value is obtained, which provides "a foundation for maximizing high quenchability".

TABLE 8

| | | Example | | | | | | | | | | | | | | | | | | | |
|---|---|---|---|---|---|---|---|---|---|---|---|---|---|---|---|---|---|---|---|---|---|
| | | 01 | 02 | 03 | 04 | 05 | 06 | 07 | 08 | 09 | 10 | 11 | 12 | 13 | 14 | 15 | 16 | 17 | 18 | 19 | 20 |
| Effect of cooling rate after hot working | X = 1° C./min | S | S | S | S | S | S | S | S | A | S | S | S | S | S | S | S | S | S | A | S |
| | X = 2° C./min | S | S | S | S | S | S | S | S | S | S | S | S | S | S | S | S | S | S | A | S |
| (1) SA Property | 30° C./H | S | S | S | S | S | S | S | S | S | S | S | S | S | S | S | S | S | S | S | S |
| | 15° C./H | S | S | S | S | S | S | S | S | S | S | S | S | S | S | S | S | S | S | S | S |
| (2) Machinability | 400 m/min, distance 30 m | B | B | B | B | B | B | B | B | B | B | B | B | B | B | B | B | B | B | A | A |
| (3) Quenchability | 1.2° C./min | S | S | S | S | S | S | S | S | A | S | S | S | S | S | S | S | S | S | A | S |
| (4) Heat checking resistance | 1.2° C./min | S | S | S | S | S | S | A | S | A | A | A | A | S | S | S | S | S | S | A | S |
| | 30° C./min | S | S | S | S | S | S | A | S | A | A | A | A | S | S | S | S | S | S | A | S |
| (5) Softening resistance | 1.2° C./min | S | S | S | S | S | S | S | S | A | A | A | A | S | S | S | S | S | S | A | S |
| | 30° C./min | S | S | S | S | S | S | S | S | A | A | A | A | S | S | S | S | S | S | A | S |

| | | Comparative Example | | | | | | | | |
|---|---|---|---|---|---|---|---|---|---|---|
| | | 01 | 02 | 03 | 04 | 05 | 06 | 07 | 08 | 09 |
| Effect of cooling rate after hot working | X = 1° C./min | C | B | B | C | S | C | B | A | C |
| | X = 2° C./min | C | A | A | B | S | B | A | S | C |
| (1) SA Property | 30° C./H | S | S | C | S | C | S | C | S | C |
| | 15° C./H | S | S | C | S | C | S | S | S | S |
| (2) Machinability | 400 m/min, distance 30 m | S | A | A | B | C | B | A | B | B |
| (3) Quenchability | 1.2° C./min | C | C | C | C | S | C | B | A | C |
| (4) Heat checking resistance | 1.2° C./min | C | C | B | A | S | B | C | S | S |
| | 30° C./min | C | B | B | S | S | A | B | S | S |
| (5) Softening resistance | 1.2° C./min | A | B | B | S | S | S | A | C | B |
| | 30° C./min | B | B | B | S | S | S | B | C | B |

While the present invention has been described in detail, the present invention is not limited to Examples, and various changes and modifications can be made therein without departing from the gist of the present invention. In Examples, the verification were performed assuming a die casting mold, but the present invention can be applied to molds or parts used not only for die casing but also for a variety of casting. Also, in addition to casting, the present invention can be applied to molds or parts used in forging by heating and processing a material, hot stamping (a method of heating, forming and quenching a steel sheet), extrusion processing, injection molding or blow molding of resins (plastics or vinyl), or molding or processing of rubbers or fiber-reinforced plastics. In the verification, the properties were evaluated at 46 HRC, but, of course, the present invention can be applied to molds or parts by adjusting the hardness over a wide range according to use.

In the verification of properties, a block material formed from an ingot is described as an example, but the steel material of the present invention can also be utilized by forming it into a powder, bar or wire. In the case where the steel material of the present invention is formed into a powder, the powder can be applied to additive manufacturing (SLM system, LMD system, etc.) or a variety of sequential manufacturing such as plasma powder welding (PPW). In the case where the steel material of the present invention is formed into a bar from an ingot, molds or parts can be manufactured therefrom. In the case where the steel material of the present invention is formed into a bar or wire from an ingot, the bar or wire can be applied to sequential manufacturing or repair of overlaying it (tungsten inert gas welding (TIG), laser welding, etc.). In the case where the steel material of the present invention is formed into a plate shape, it is also possible to manufacture molds or parts by bonding the plates. Of course, it is possible as well to manufacture molds or parts by bonding a member composed of the steel material of the present invention. As described above, the steel material having the components of the steel material of the present invention can be applied to various shapes. In addition, molds or parts can be manufactured or repaired by various methods from materials of various shapes, each composed of the components of the steel material of the present invention.

The present application is based on Japanese Patent Application No. 2021-087176 filed on May 24, 2021, and the contents thereof are incorporated herein by reference.

What is claimed is:

1. A steel material comprising, in mass %:

$0.310 \leq C \leq 0.410$;

$0.001 \leq Si \leq 0.35$;

$0.6 < V \leq 0.70$;

$Cr \leq 6.00$;

$6.25 \leq Mn+Cr$;

$Mn/Cr \leq 0.155$;

$Cu+Ni \leq 0.84$;

$0.002 \leq P \leq 0.030$;

$0.0003 \leq S \leq 0.0060$;

$0.0035 \leq P+5S \leq 0.040$;

$2.10 \leq Mo \leq 2.39$;

$0.001 \leq Al \leq 0.050$; and $0.013 \leq N \leq 0.040$, with the balance being Fe and unavoidable impurities, wherein the steel has an impact value of 30 J/cm$^2$ or more, and wherein the steel has simultaneously a fracture toughness of >50 Mpa·√m and an S reduction in hardness of ≤2.1 HRC.

2. The steel material according to claim 1, comprising the Cr and Mn in ranges of, in mass %, $5.58 \leq Cr \leq 6.00$ and $0.60 \leq Mn \leq 0.86$.

3. The steel material according to claim 1, further comprising, in mass %, at least one element selected from the group consisting of $0.30 < W \leq 2.00$ and $0.30 < Co \leq 1.00$.

4. The steel material according to claim 1, further comprising, in mass %, $0.0002 < B \leq 0.0080$.

5. The steel material according to claim 1, further comprising, in mass %, at least one element selected from the group consisting of $0.004 < Nb \leq 0.100$, $0.004 < Ta \leq 0.100$, $0.004 < Ti \leq 0.100$, and $0.004 < Zr \leq 0.100$.

6. The steel material according to claim 1, further comprising, in mass %, at least one element selected from the group consisting of $0.0005 < Ca \leq 0.0500$, $0.03 < Se \leq 0.50$, $0.005 < Te \leq 0.100$, $0.01 < Bi \leq 0.50$, and $0.03 < Pb \leq 0.50$.

7. The steel material according to claim 1, wherein the steel material has the impact value of 30 J/cm$^2$ or more when a square bar of 12 mm×12 mm×55 mm prepared from the steel material is thermally refined to a hardness of 45.5 HRC to 46.5 HRC by the following heat treatment in a vacuum furnace, an impact test specimen is prepared from the square bar, and an impact test is conducted at 15° C. to 35° C., in the heat treatment, the square bar is held at 1,250° C. for 0.5 H; then cooled from 1,250° C. to 1,000° C. at 2° C./min to 10° C./min, cooled from 1,000° C. to 600° C. at 2° C./min, and cooled from 600° C. to 150° C. at 2° C./min to 10° C./min; then heated to Ac3 temperature+25° C.; held at Ac3 temperature+25° C. for 1 H; then cooled from Ac3 temperature+25° C. to 620° C. at 15° C./H, and cooled from 620° C. to 150° C. at 30° C./H to 60° C./H; subsequently held at 1,030° C. for 1 H; then cooled from 1,030° C. to 600° C. at 60° C./min to 100° C./min, cooled from 600° C. to 450° C. at 45° C./min to 100° C./min, cooled from 450° C. to 250° C. at 30° C./min to 100° C./min, and cooled from 250° C. to 150° C. at 5° C./min to 30° C./min; and subsequently, a cycle consisting of heating to a temperature range of 580° C. to 630° C. and cooling to 100° C. or less is applied one or more times.

8. A steel product formed of the steel material according to claim 7.

9. The steel material according to claim 1, wherein the steel material comprises no carbides having a maximum length of more than 0.3 μm, or if the steel material comprises carbides having a maximum length of more than 0.3 μm, carbides forming a dashed-line-form discontinuous string at intervals of 50 μm or less has the maximum length of more than 0.3 μm and less than 0.6 μm, or a length of a dashed-line-form discontinuous string at intervals of 50 μm or less is less than 300 μm when the dashed-line-form discontinuous string is formed of carbides having a maximum length of 0.6 μm or more.

10. The steel material according to claim 1, wherein the steel has a hardness of 46.5 HRC or more after quenching.

* * * * *